US012623878B2

(12) United States Patent
Ito et al.

(10) Patent No.: US 12,623,878 B2
(45) Date of Patent: May 12, 2026

(54) PRINTING APPARATUS, CONTROL METHOD, AND STORAGE MEDIUM

(71) Applicant: CANON KABUSHIKI KAISHA, Tokyo (JP)

(72) Inventors: Masashi Ito, Tokyo (JP); Keisuke Arita, Tokyo (JP); Motoyuki Taguchi, Tokyo (JP); Kento Tamari, Saitama (JP); Sho Takahashi, Kanagawa (JP); Ryota Komatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 18/661,217

(22) Filed: May 10, 2024

(65) Prior Publication Data

US 2024/0375906 A1 Nov. 14, 2024

(30) Foreign Application Priority Data

May 12, 2023 (JP) ..... 2023-079581

(51) Int. Cl.
*B65H 29/68* (2006.01)
*B65H 29/66* (2006.01)

(52) U.S. Cl.
CPC ..... *B65H 29/683* (2013.01); *B65H 29/6618* (2013.01); *B65H 2301/331* (2013.01);
(Continued)

(58) Field of Classification Search
CPC ..... B65H 29/683; B65H 29/6618; B65H 2301/331; B65H 2513/10; B65H 2513/50; B65H 2601/255; B65H 2801/12
See application file for complete search history.

(56) References Cited

U.S. PATENT DOCUMENTS 9,333,773 B2 5/2016 Taniguchi et al.
9,370,946 B2 * 6/2016 Nishida ..... B41J 13/0018
(Continued)

FOREIGN PATENT DOCUMENTS

JP 6-56299 A 3/1994
JP 2001-331074 A 11/2001
(Continued)

OTHER PUBLICATIONS

U.S. Appl. No. 18/733,140, Ryota Komatsu, Masashi Ito, Motoyuki Taguchi, Sho Takahashi, Keisuke Arita, Kento Tamari, filed Jun. 4, 2024.

(Continued)

*Primary Examiner* — Thomas A Morrison
(74) *Attorney, Agent, or Firm* — Venable LLP

(57) ABSTRACT

A printing apparatus includes a printing unit, first and second conveyance units conveying a print medium, and a control unit performing reduction control to reduce an overlap amount between a preceding print medium and a succeeding print medium by using a speed difference. In a first case in which a trailing end of the preceding print medium and a leading end of the succeeding print medium are positioned in an interval between the first and second conveyance units, a conveying speed of the preceding print medium is set to a first speed. In a second case which is different from the first case and in which the trailing end and the leading end are positioned in the interval between the first and second conveyance units, the conveying speed of the preceding print medium is set to a second speed different from the first speed.

13 Claims, 17 Drawing Sheets

(52) U.S. Cl.
CPC ..... *B65H 2513/10* (2013.01); *B65H 2513/50* (2013.01); *B65H 2601/255* (2013.01); *B65H 2801/12* (2013.01)

(56) References Cited

U.S. PATENT DOCUMENTS

| | | | | |
|---|---|---|---|---|
| 9,443,173 | B2 * | 9/2016 | Taguchi | B65H 5/24 |
| 9,586,780 | B2 * | 3/2017 | Nishida | B65H 5/062 |
| 10,447,875 | B2 | 10/2019 | Suzuki et al. | |
| 10,766,724 | B2 | 9/2020 | Tai | |
| 2016/0052311 | A1 * | 2/2016 | Taniguchi | B41J 13/0009 347/16 |
| 2023/0294426 | A1 | 9/2023 | Sugiyama et al. | |
| 2023/0311543 | A1 | 10/2023 | Ito et al. | |

FOREIGN PATENT DOCUMENTS

| | | | |
|---|---|---|---|
| JP | 2016-044058 | A | 4/2016 |
| JP | 2018-167938 | A | 11/2018 |

OTHER PUBLICATIONS

Office Action dated Jun. 13, 2025, in Japanese Patent Application No. 2023-079581.

* cited by examiner

PRINTING APPARATUS, CONTROL METHOD, AND STORAGE MEDIUM

BACKGROUND OF THE INVENTION

Field of the Invention

The present invention relates to a conveyance control technique for print media in a printing apparatus.

Description of the Related Art

There is known a printing apparatus that conveys print media in an overlap state in which the succeeding print medium overlaps the trailing end of the preceding print medium and performs printing on the succeeding print medium. Such conveyance control can improve the printing efficiency. On the other hand, there is provided a technique of canceling the overlap state between a preceding print medium and a succeeding print medium in consideration of the discharging ability of print media and the prevention of a jam. For example, Japanese Patent Laid-Open No. 6-56299 proposes a printing apparatus that cancels an overlap state by increasing the conveying speed of a preceding print medium.

Uniformly increasing the conveying speed of a preceding print medium when canceling an overlap state sometimes causes noise in a driving system or an increase in power consumption.

SUMMARY OF THE INVENTION

The present invention provides a technique that can suppress noise in a driving system or an increase in power consumption when canceling an overlap state.

According to one aspect of the present invention, there is provided a printing apparatus comprising: a printing unit configured to print an image on a print medium; a first conveyance unit configured to convey the print medium in a conveying direction; a second conveyance unit configured to convey the print medium having undergone printing by the printing unit on a downstream side of the first conveyance unit in the conveying direction; and a control unit configured to perform reduction control to reduce an overlap amount between a preceding print medium and a succeeding print medium by using a speed difference between the preceding print medium and the succeeding print medium in an overlap state in which the succeeding print medium overlaps a trailing end of the preceding print medium, wherein in a first case in which a trailing end of the preceding print medium and a leading end of the succeeding print medium are positioned in an interval between the first conveyance unit and the second conveyance unit, the control unit is configured to execute the reduction control in which a conveying speed of the preceding print medium is set to a first speed and in a second case which is different from the first case and in which the trailing end of the preceding print medium and the leading end of the succeeding print medium are positioned in the interval between the first conveyance unit and the second conveyance unit, the control unit is configured to execute the reduction control in which the conveying speed of the preceding print medium is set to a second speed different from the first speed.

Further aspects of the present invention will become apparent from the following description of exemplary embodiments with reference to the attached drawings.

DESCRIPTION OF THE EMBODIMENTS

Figure 1:
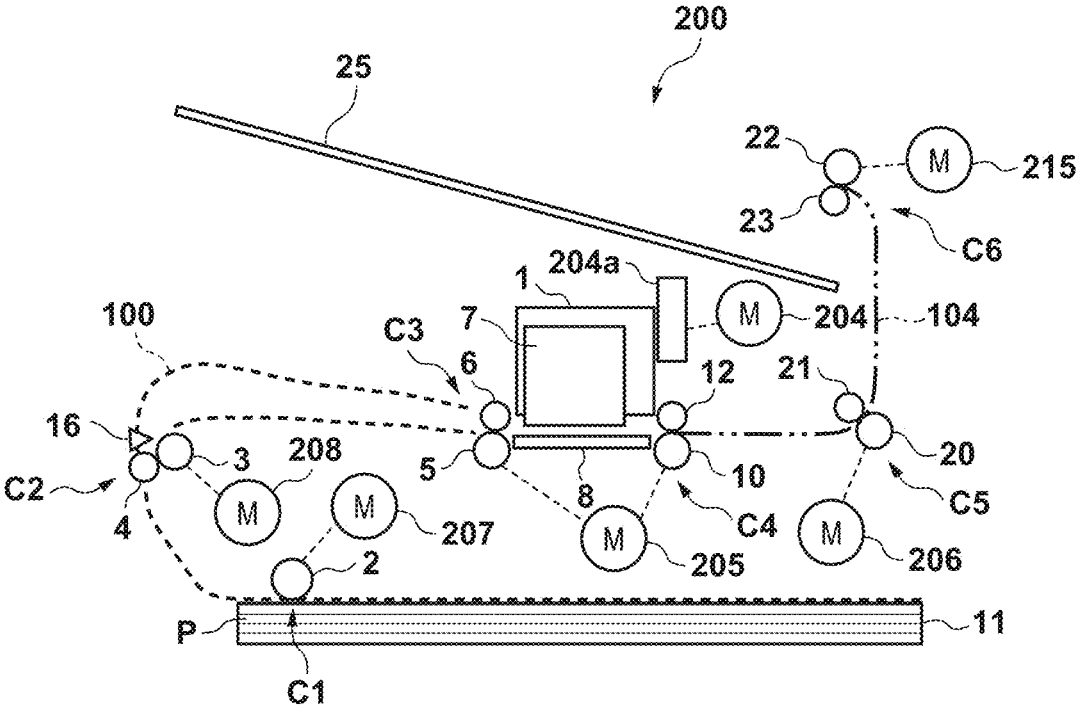
FIG. 1 is a schematic view of a printing apparatus according to an embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

<Outline>

FIG. 1 is a schematic view of a printing apparatus 200 according to this embodiment. The printing apparatus 200 according to the embodiment is an inkjet printing apparatus that performs printing by discharging ink to a print medium P.

Note that "print" is not limited to formation of significant information such as a character or figure and includes, in a broad sense, formation of an image, design, pattern, or the like on a print medium or processing of a medium, regardless of whether information is significant or insignificant, or whether information is so visualized as to allow the user to visually perceive it. Also, in this embodiment, "print medium" is assumed to be sheet-shaped paper, but it may be fabric, plastic film, or the like.

The printing apparatus 200 includes a stacking unit 11 and a discharge unit 25. The stacking unit 11 is a tray on which a plurality of print media P are stacked. The discharge unit 25 is a tray on which image-printed print media P are stacked. The printing apparatus 200 includes conveyance units C1 to C6 configured to convey the print medium P from the stacking unit 11 to the discharge unit 25 along a conveyance path and a printhead 7 placed midway along the conveyance path of the print medium P. The conveyance path defines the conveying direction of the print medium P. An upstream side and a downstream side are sometimes referred to with reference to the conveying direction of the print medium P. The upstream side means a side along the stacking unit 11, and the downstream side means a side along the discharge unit 25. The conveyance units C1 to C6 are arranged from the upstream side in this order.

The conveyance units C3 and C4 can also be referred to as medium transfer units considering that the units mainly transfer the print medium P to the printhead 7 during printing of an image by the printhead 7. The conveyance units C1 and C2 can also be referred to as feed units considering that the units mainly feed the print medium P from the stacking unit 11. The conveyance units C5 and C6 can also be referred to as discharge units considering that the units mainly discharge the printed print medium P to the discharge unit 25.

The conveyance unit C1 includes a pickup roller 2 using a motor 207 as a drive source. The pickup roller 2 comes into contact with the uppermost print medium P stacked on the stacking unit 11 to pick up the print media P one by one. The conveyance unit C2 includes a feed roller 3 as a driving roller using a motor 208 as a drive source and a feed driven roller 4 that feeds the print medium P while holding it together with the feed roller 3. The print medium P picked up by the pickup roller 2 is fed by the conveyance unit C2 to the downstream side while being guided by a conveyance guide 100.

In this embodiment, the pickup roller 2 is a one-way roller, which can run idle. After the print medium P reaches the feed roller 3, the feed roller 3 can continue conveying the print medium P even if the pickup roller 2 stops driving. Although the embodiment exemplifies the arrangement including the pickup roller 2 and the feed roller 3, the embodiment may be configured to feed the print medium P stacked on the stacking unit 11 by using only the feed roller 3.

A detection sensor 16 is a sensor that detects the leading end and trailing end of the print medium P and is, for example, an optical sensor. The detection position of the detection sensor 16 is positioned downstream of the feed roller 3 and upstream of the conveyance unit C3.

The conveyance unit C3 includes a conveyance roller 5 as a driving roller using a motor 205 as a drive source and a pinch roller 6 that comes into pressure contact with the conveyance roller 5 to form a nip portion and feeds the print medium P while holding it together with the conveyance roller 5. The conveyance unit C3 conveys the print medium P fed by the conveyance unit C2 to a position facing the printhead 7 (a position between the printhead 7 and a platen 8 facing the printhead 7).

The printhead 7 prints an image on the print medium P. In this embodiment, the printhead 7 is an inkjet printhead that performs printing by discharging ink onto the print medium P. The platen 8 supports the print medium P from below. The printhead 7 is mounted on a carriage 1. A moving mechanism 204*a* using a motor 204 as a drive source moves the carriage 1 in a direction intersecting the conveying direction of the print medium P (the widthwise direction of the print medium P).

The conveyance unit C4 includes a conveyance roller 10 as a driving roller using the motor 205 as a drive source and a spur 12 that rotates upon coming into contact with the printing surface of the print medium P. The conveyance unit C4 further conveys the print medium P conveyed by the conveyance unit C3 to the downstream side. The spur 12 is biased against the conveyance roller 10. The conveyance unit C3 and the conveyance unit C4 share the motor 205.

The conveyance unit C5 includes a conveyance roller 20 as a driving roller using a motor 206 as a drive source and a conveyance driven roller 21 that forms a nip portion by coming into pressure contact with the conveyance roller 20 and conveys the print medium P while holding it together with the conveyance roller 20. The conveyance unit C5 further conveys the print medium P conveyed by the conveyance unit C4 to the downstream side along a conveyance path 104.

The conveyance unit C6 includes a discharge roller 22 as a driving roller using a motor 215 as a drive source and a discharge driven roller 23 that comes into pressure contact with the discharge roller 22 to form a nip portion and conveys the print medium P while holding it together with the discharge roller 22. The conveyance unit C6 discharges the print medium P conveyed by the conveyance unit C5 onto the discharge unit 25.

<Control System>

Figure 2:
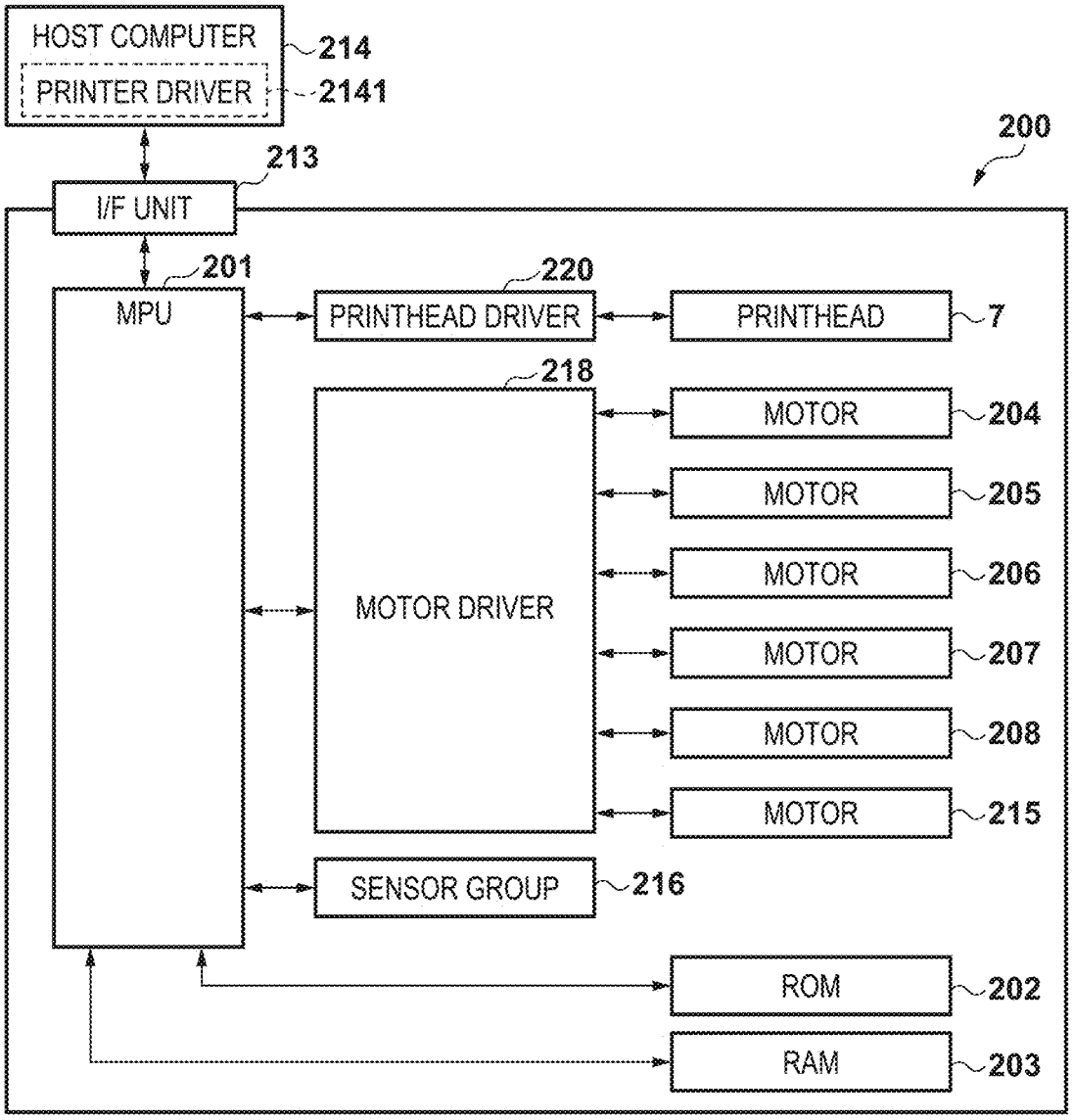
FIG. 2 is a block diagram of the control system of the printing apparatus in FIG. 1.

FIG. 2 is a block diagram of the control system of the printing apparatus 200. An MPU 201 is a control unit that includes at least one processor and controls the overall printing apparatus 200. A ROM 202 and a RAM 203 are storage devices, more specifically, semiconductor memories. The ROM 202 is a semiconductor memory that stores programs executed by the MPU 201 and data. The RAM 203 is a semiconductor memory that temporarily stores processed data obtained by the MPU 201 and data received from a host computer 214.

A printhead driver 220 controls the printhead 7. A motor driver 218 controls the motors 204 to 208 and 215. A sensor group 216 includes various types of sensors provided in the printing apparatus 200, for example, the detection sensor 16, a sensor (not shown) that detects the rotation amount of the feed roller 3, and a sensor (not shown) that detects the rotation amount of the conveyance roller 5. The host computer 214 is provided with a printer driver 2141 that transmits print data (a print job) such as a print image and print conditions to the printing apparatus 200 when the user issues an instruction to execute a printing operation. The MPU 201 executes information communication with the host computer 214 via an interface unit (I/F unit) 213.

<Printing Operation Procedure>

An example of the operation of the printing apparatus 200 will be described with reference to FIGS. 3 to 9. The following is a description of an example of continuously performing an operation of printing an image on one surface of each of two print media P. That is, the operation will be described in chronological order by exemplifying a case where one job includes two-page print data. When the host computer 214 transmits print data via the I/F unit 213, the MPU 201 processes the print data. The processed data is then deployed in the RAM 203. The MPU 201 starts a printing operation based on the deployed data.

Figure 3:
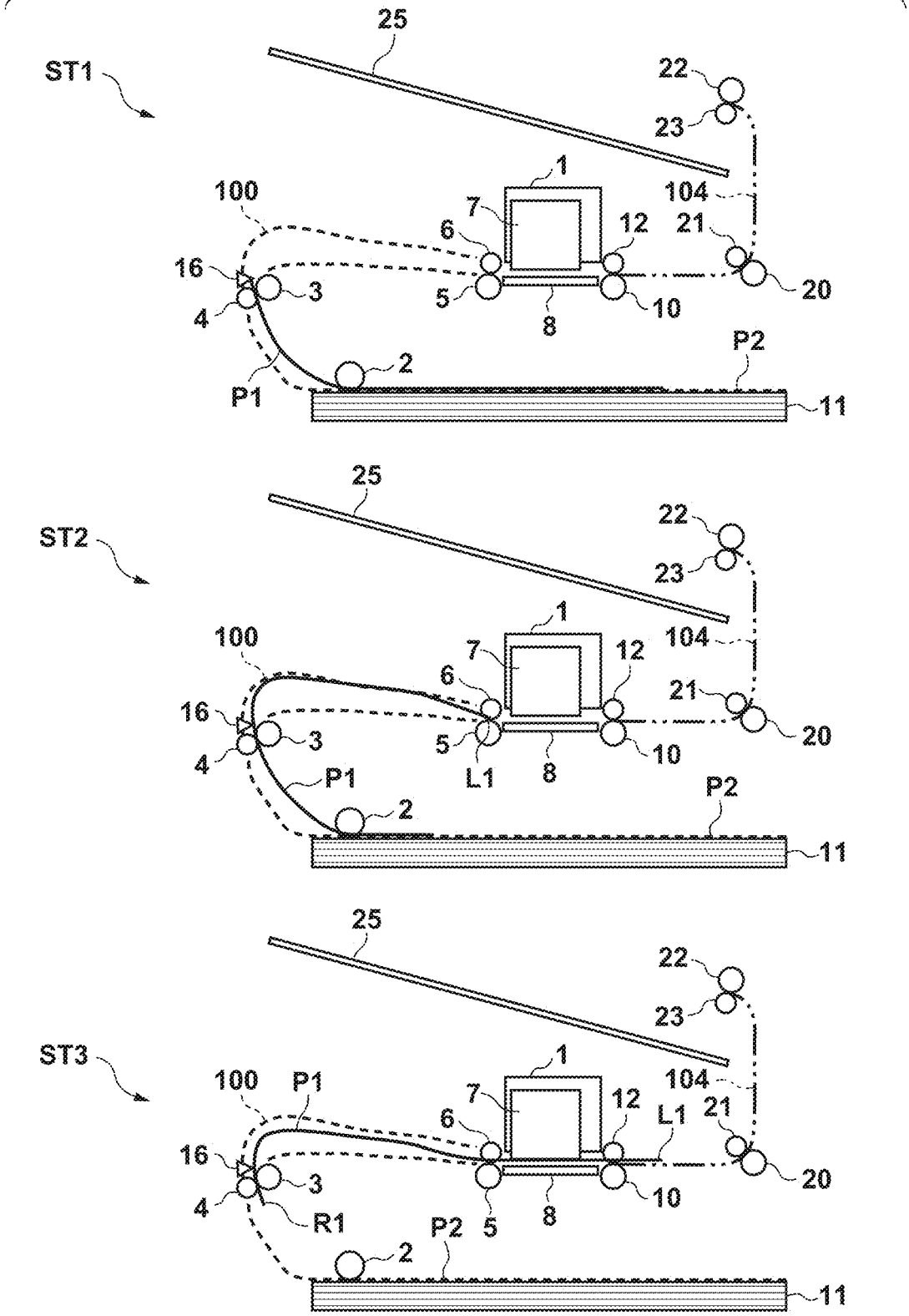
FIG. 3 is a view for explaining the operation of the printing apparatus in FIG. 1.

Referring to ST1 in FIG. 3, first of all, the motor 207 is driven at a low speed. This will rotate the pickup roller 2 at, for example, 7.6 inches/sec. As the pickup roller 2 rotates, the uppermost print medium P stacked on the stacking unit 11 is picked up. A first preceding print medium P1 picked up by the pickup roller 2 is conveyed by the feed roller 3 rotating in the same direction as that of the pickup roller 2.

The motor 208 drives the feed roller 3 at the same conveying speed as that of the preceding print medium P1 conveyed by the pickup roller 2.

The pickup roller 2 is rotated by a predetermined amount that allows conveyance of the preceding print medium P1 to a position exceeding the feed roller 3. Thereafter, the pickup roller 2 is stopped so as not to pick up a next succeeding print medium P2. When the detection sensor 16 detects the leading end of the preceding print medium P1, the motor 208 is switched to high-speed driving. For example, the feed roller 3 rotates at 20 inches/sec.

Referring to ST2 in FIG. 3, when the feed roller 3 continues rotating, a conveying direction leading end L1 of the preceding print medium P1 abuts against the nip portion formed by the conveyance roller 5 and the pinch roller 6. At this time, the conveyance roller 5 is in a stop state. Rotating the feed roller 3 by a predetermined amount even after the leading end L1 of the preceding print medium P1 abuts against the conveyance nip portion causes the leading end L1 of the preceding print medium P1 to uniformly abut against the nip portion and be bent. This corrects the skew of the preceding print medium P1. Such a skew correcting operation is also called a registering operation.

Referring to ST3 in FIG. 3, when the skew correcting operation is completed for the preceding print medium P1, the motor 205 is driven to start rotating the conveyance roller 5. The conveyance roller 5 conveys the preceding print medium P1 at, for example, 15 inches/sec. The preceding print medium P1 is aligned to a position facing the printhead 7. To align means to make the first printing position of the preceding print medium P1 face the printhead 7. An aligning operation is performed by controlling the rotation amount of the conveyance roller 5 from a state in which the leading end L1 of the preceding print medium P1 abuts against the nip portion. Discharging ink from the printhead 7 based on print data will start printing first-page print data on the preceding print medium P1.

The printing apparatus 200 according to this embodiment is a serial type printing apparatus having the printhead 7 mounted on the carriage 1. A printing operation is performed by alternately repeating an intermittent conveying operation for the print medium P and a print scan operation. An intermittent conveying operation is an operation of conveying the print medium P by a predetermined amount and then stopping the operation. This operation is performed by using only the conveyance roller 5 or both the conveyance roller 5 and the conveyance roller 10. A printing scan operation is an operation of discharging ink while moving the printhead 7 in the widthwise direction of the print medium P by moving the carriage 1 in a state in which the conveyance of the print medium P is stopped. Such a printing operation will proceed with printing an image on the preceding print medium P1.

When the preceding print medium P1 is aligned, the motor 208 is switched to low-speed driving. For example, the feed roller 3 rotates at 7.6 inches/sec. When an intermittent conveying operation is performed for the preceding print medium P1, an intermittent conveying operation is performed for the feed roller 3. That is, when the conveyance roller 5 rotates, the feed roller 3 also rotates. When the conveyance roller 5 stops, the feed roller 3 also stops. The rotational speed of the feed roller 3 is lower than that of the conveyance roller 5. Accordingly, the preceding print medium P1 is stretched between the conveyance roller 5 and the feed roller 3. In addition, the feed roller 3 is rotated in interlock with the preceding print medium P1 conveyed by the conveyance roller 5.

When an intermittent conveying operation is performed for the preceding print medium P1 using the conveyance roller 5, the conveyance roller 20 and the discharge roller 22 are also intermittently driven in the same rotating direction and at the same speed as those of the conveyance roller 5. That is, when the conveyance roller 5 rotates, the conveyance roller 20 and the discharge roller 22 also rotate. When the conveyance roller 5 is stopped, the conveyance roller 20 and the discharge roller 22 are also stopped.

A predetermined interval is required between the consecutive print media P to detect an end portion of the print medium P by using the detection sensor 16 in consideration of factors such as the responsiveness of the detection sensor 16. That is, a predetermined time needs to be provided between the instant when a trailing end R1 of the preceding print medium P1 is detected by the detection sensor 16 and the instant when a leading end L2 of the second succeeding print medium P2 is detected. Accordingly, conveyance control is performed to leave a predetermined distance between the trailing end R1 of the preceding print medium P1 and the leading end L2 of the succeeding print medium P2. A pickup operation is performed for the succeeding print medium P2 upon determination of the passage of the trailing end R1 of the preceding print medium P1 by the detection sensor 16. In addition, the rotation of the pickup roller 2 is controlled to set the interval between the trailing end R1 of the preceding print medium P1 and the leading end L2 of the succeeding print medium P2 to a predetermined distance or more. The leading end position and trailing end position of each print medium P may be obtained from the rotation amount of each roller or by calculation with a sensor provided additionally.

Figure 4:
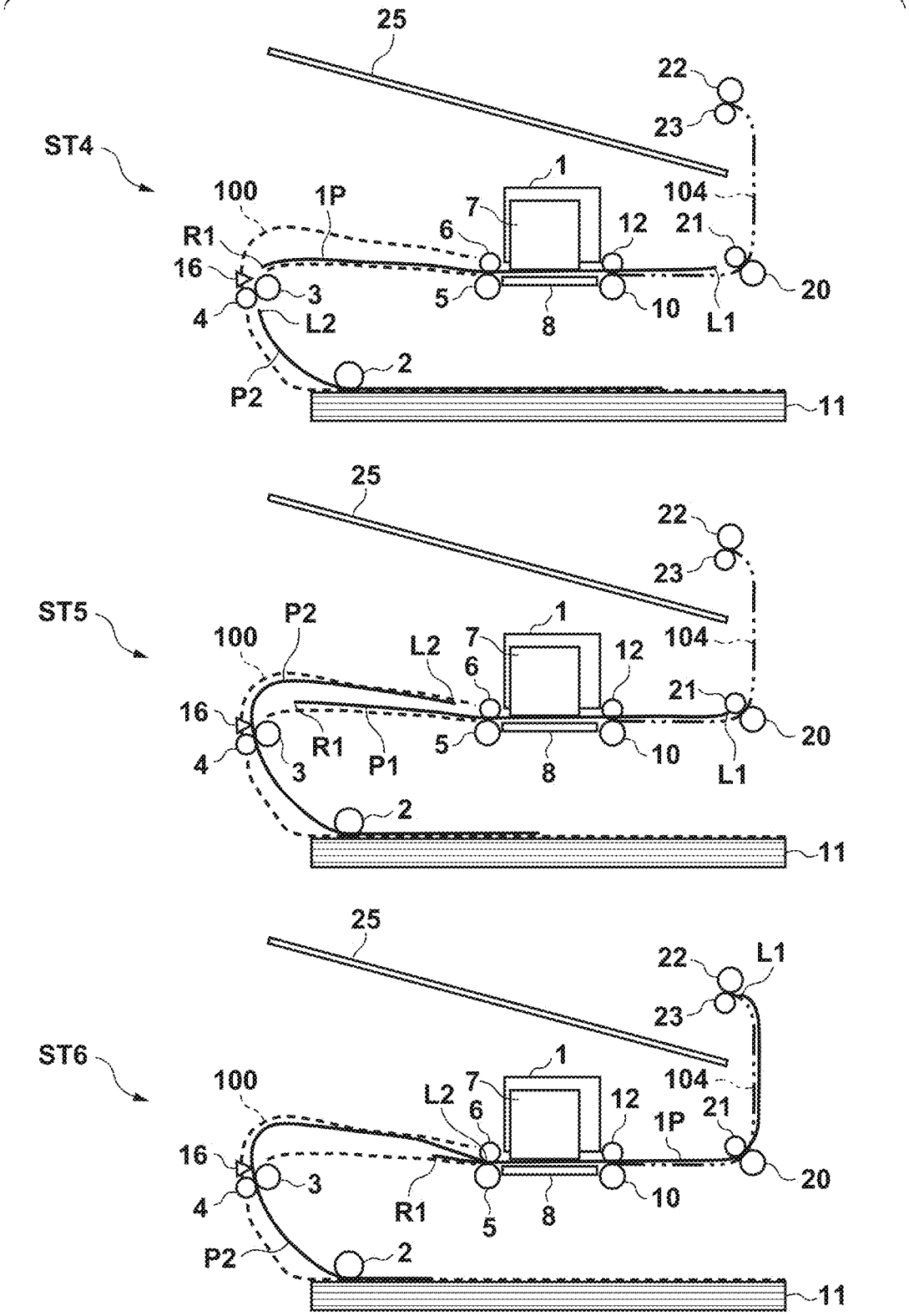
FIG. 4 is a view for explaining the operation of the printing apparatus in FIG. 1.

Referring to ST4 in FIG. 4, the feed roller 3 conveys the succeeding print medium P2 picked up by the pickup roller 2. At this time, a printing operation for the preceding print medium P1 is continued. When the detection sensor 16 detects the leading end L2 of the succeeding print medium P2, the motor 208 is switched to high-speed driving. That is, the feed roller 3 rotates at, for example, 20 inches/sec.

Referring to ST5 in FIG. 4, the succeeding print medium P2 is moved at a high speed relative to the speed at which the preceding print medium P1 is moved downstream in a printing operation. This can form an overlap state in which the leading end of the succeeding print medium P2 overlaps on the trailing end of the preceding print medium P1. In this embodiment, since the preceding print medium P1 is conveyed by the repetition of an intermittent conveying operation during a printing operation, continuously rotating the feed roller 3 enables the succeeding print medium P2 to catch up with the preceding print medium P1. The succeeding print medium P2 is fed until the leading end L2 reaches a position located upstream by a predetermined distance from the nip portion between the conveyance roller 5 and the pinch roller 6. The position of the leading end L2 of the succeeding print medium P2 is calculated from the rotation amount of the feed roller 3 from when the leading end L2 of the succeeding print medium P2 is detected by the detection sensor 16 and is controlled based on the calculation result.

(Overlap Operation by Overlap Control)

Figure 5:
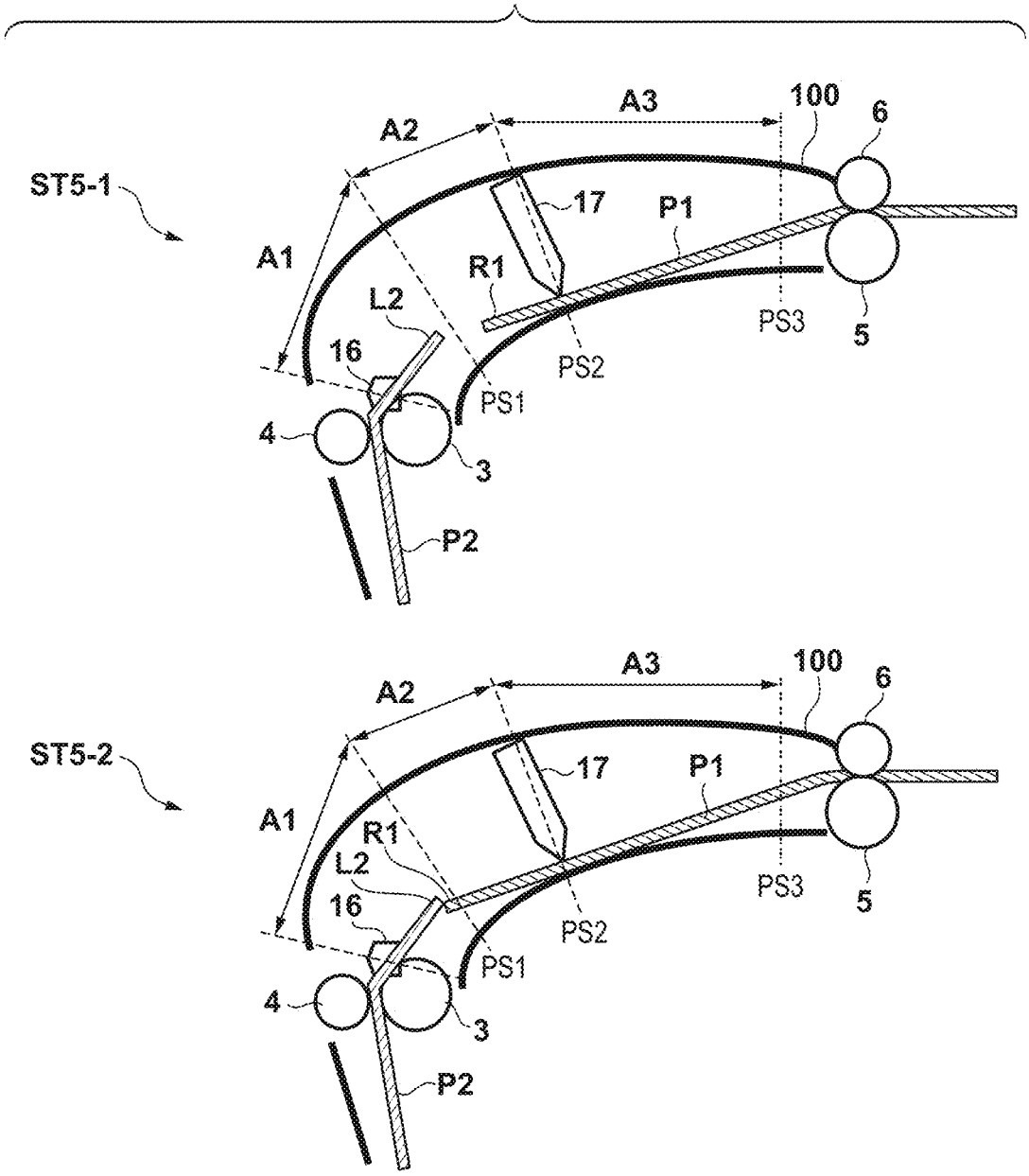
FIG. 5 is a view for explaining the operation of the printing apparatus in FIG. 1.
Figure 6:
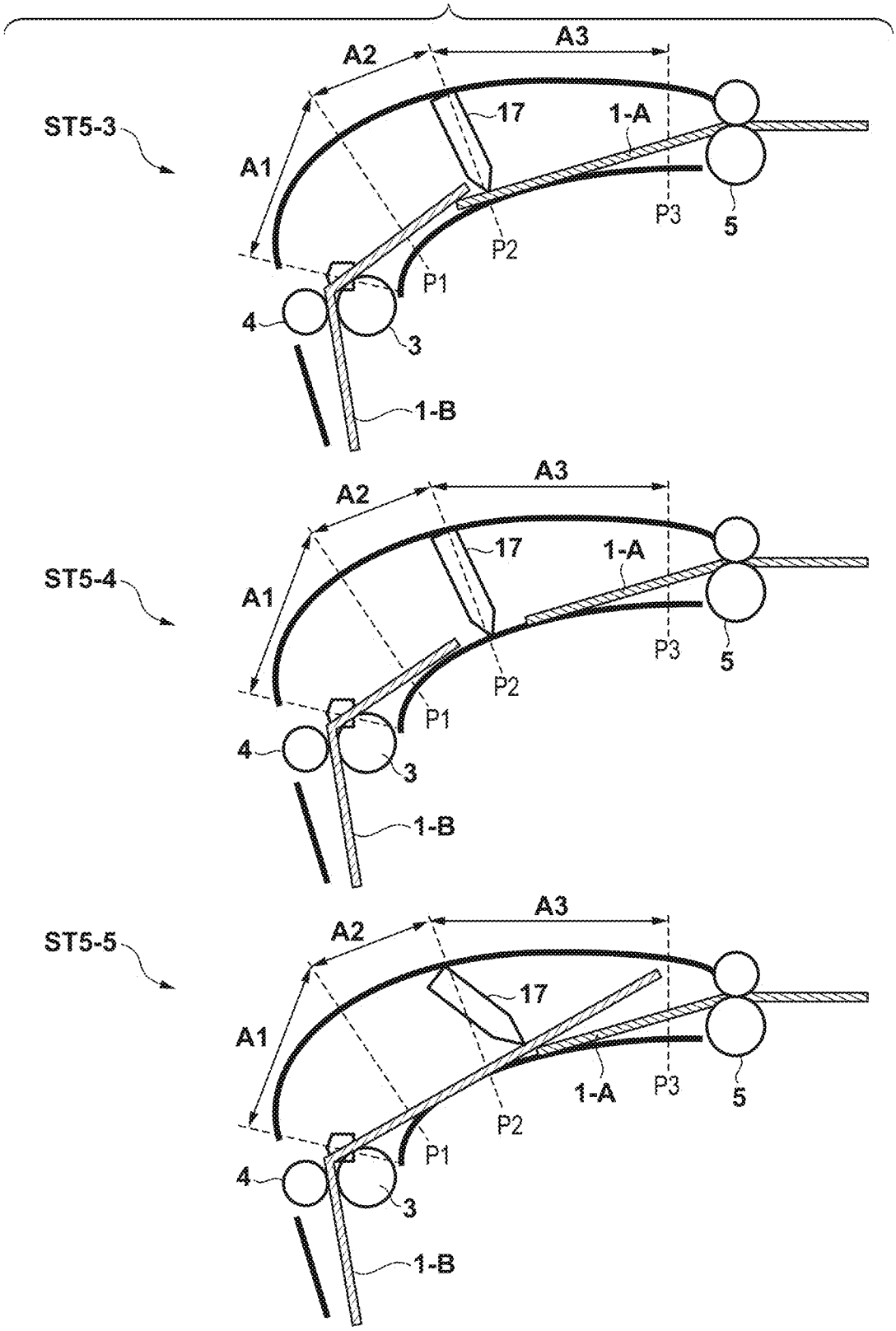
FIG. 6 is a view for explaining the operation of the printing apparatus in FIG. 1.

An operation of forming an overlap state will be described in detail with reference to FIGS. 5 and 6. FIGS. 5 and 6 are enlarged views of the conveyance interval between the nip portion formed by the feed roller 3 and the feed driven roller 4 and the nip portion formed by the conveyance roller 5 and the pinch roller 6. This interval is provided with a lever 17 that suppresses the trailing end portion of the print medium P from floating. The lever 17 is pivotally supported at its upper end portion.

A process of conveying the print medium P using the conveyance roller 5 and the feed roller 3 will be sequentially described in three states. The first state in which the succeeding print medium P2 follows the preceding print medium P1 will be described with reference to ST5-1 and ST5-2 in FIG. 5. The second state in which the succeeding print medium P2 is overlapped on the preceding print medium P1 will be described with reference to ST5-3 and ST5-4 in FIG. 6. The third state in which it is determined whether to perform a skew correcting operation for the succeeding print medium P2 while maintaining an overlap state will be described with reference to ST5-5 in FIG. 6.

In ST5-1 in FIG. 5, the feed roller 3 is driven to convey the succeeding print medium P2, and the detection sensor 16 detects the leading end L2 of the succeeding print medium P2. The interval from the detection sensor 16 to a position PS1 where the succeeding print medium P2 can be overlapped on the preceding print medium P1 is defined as a first interval A1. In the first interval A1, the leading end L2 of the succeeding print medium P2 follows the trailing end R1 of the preceding print medium P1. The position PS1 is decided by the arrangement of the mechanism.

In the first state, in the first interval A1, there is a case where the operation of following is stopped. If the leading end L2 of the succeeding print medium P2 overtakes the trailing end R1 of the preceding print medium P1 before the position PS1 as in ST5-2 in FIG. 5, an operation of overlapping the succeeding print medium P2 on the preceding print medium P1 is not performed.

In ST5-3 in FIG. 6, the interval from the position PS1 to a position PS2 where the lever 17 is provided is defined as a second interval A2. In the second interval A2, an operation of overlapping the succeeding print medium P2 on the trailing end R1 of the preceding print medium P1 is performed.

In the second state, in the second interval A2, there is a case where an operation of overlapping the succeeding print medium P2 on the preceding print medium P1 is stopped. In a case where the leading end L2 of the succeeding print medium P2 cannot catch up with the trailing end R1 of the preceding print medium P1 in the second interval A2 as in ST5-4 in FIG. 6, the succeeding print medium P2 cannot be overlapped on the preceding print medium P1.

In ST5-5 in FIG. 6, the interval from the position PS2 to a position PS3 is defined as a third interval A3. At the position PS3, while the succeeding print medium P2 overlaps the preceding print medium P1, the succeeding print medium P2 is conveyed until the leading end L2 of the succeeding print medium P2 reaches the position PS3. In the third interval A3, it is determined whether to perform a skew correcting operation for the succeeding print medium P2 while maintaining an overlap state or perform a skew correcting operation upon canceling an overlap state. If it is determined that a skew correcting operation is performed upon cancellation of an overlap state, the subsequent processing is the same as that for the preceding print medium P1.

Processing to be performed if it is determined that the overlap state is maintained and the skew correcting operation is performed will be described with reference to ST6 in FIG. 4. A skew correcting operation is performed for the succeeding print medium P2 when the conveyance roller 5 is stopped to perform a printing scan operation for the last line of the preceding print medium P1. In this case, the feed roller 3 is driven to cause the leading end L2 of the succeeding print medium P2 to abut against the nip portion between the conveyance roller 5 and the pinch roller 6, thereby correcting the skew of the succeeding print medium P2.

Figure 7:
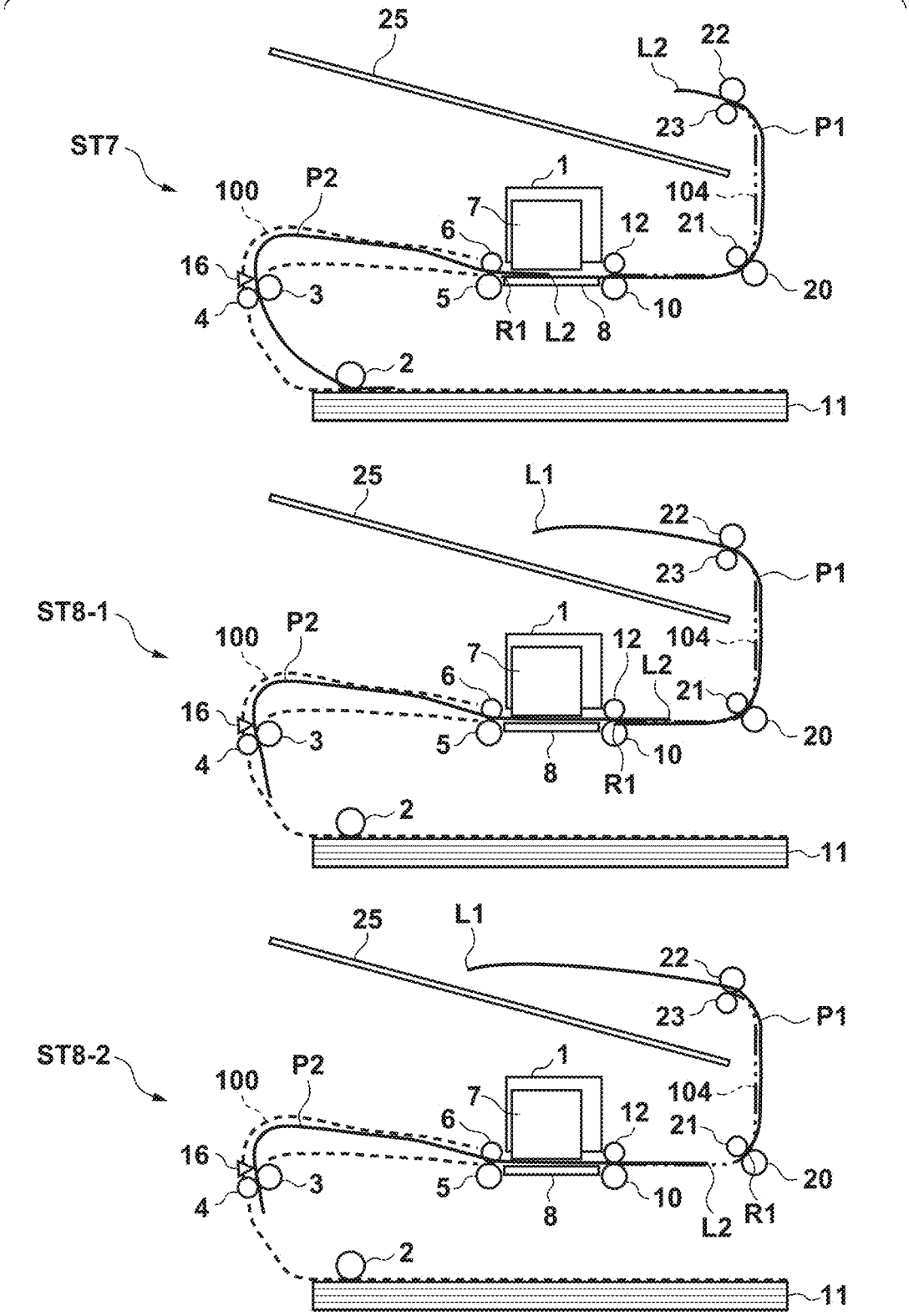
FIG. 7 is a view for explaining the operation of the printing apparatus in FIG. 1.

Referring to ST7 in FIG. 7, when a printing scan operation for the last line of the preceding print medium P1 is completed, the conveyance roller 5 is rotated by a predetermined amount to align the succeeding print medium P2 while maintaining the overlap state. At this time, both the trailing end portion of the preceding print medium P1 and the leading end portion of the succeeding print medium P2 are held at the nip portion between the conveyance roller 5 and the pinch roller 6 to convey both media.

When the succeeding print medium P2 is aligned, the motor 208 is switched to low-speed driving. For example, the feed roller 3 rotates at 7.6 inches/sec. A printing operation based on the second-page print data of the succeeding print medium P2 is started with respect to the succeeding print medium P2. In the intermittent conveying operation for the succeeding print medium P2, the feed roller 3 also performs an intermittent conveying operation. In the intermittent conveying operation for the succeeding print medium P2, an intermittent conveying operation is also performed for the preceding print medium P1. Subsequently, an image is printed on the succeeding print medium P2.

(Separating Operation by Reduction Control)

In this embodiment, it is possible to execute conveyance control to convey the preceding print medium P1 and the succeeding print medium P2 while overlapping the succeeding print medium P2 on the preceding print medium P1. If, however, the print media P are to be discharged in the face down scheme onto the discharge unit 25 in this overlap state, the order of the print media P is interchanged, resulting in a deterioration in discharging performance. For example, in the discharge unit 25, the stacking order (page order) of the preceding print medium P1 and the succeeding print medium P2 is sometimes interchanged or a paper jam sometimes occurs. Accordingly, in the embodiment, it is possible to execute reduction control to reduce the overlap amount between the preceding print medium P1 and the succeeding print medium P2 using the speed difference between them. This reduction control is executed to perform a separating operation with respect to the preceding print medium P1 and the succeeding print medium P2. With this operation, the preceding print medium P1 and the succeeding print medium P2 are discharged in a non-overlap state.

Figure 8:
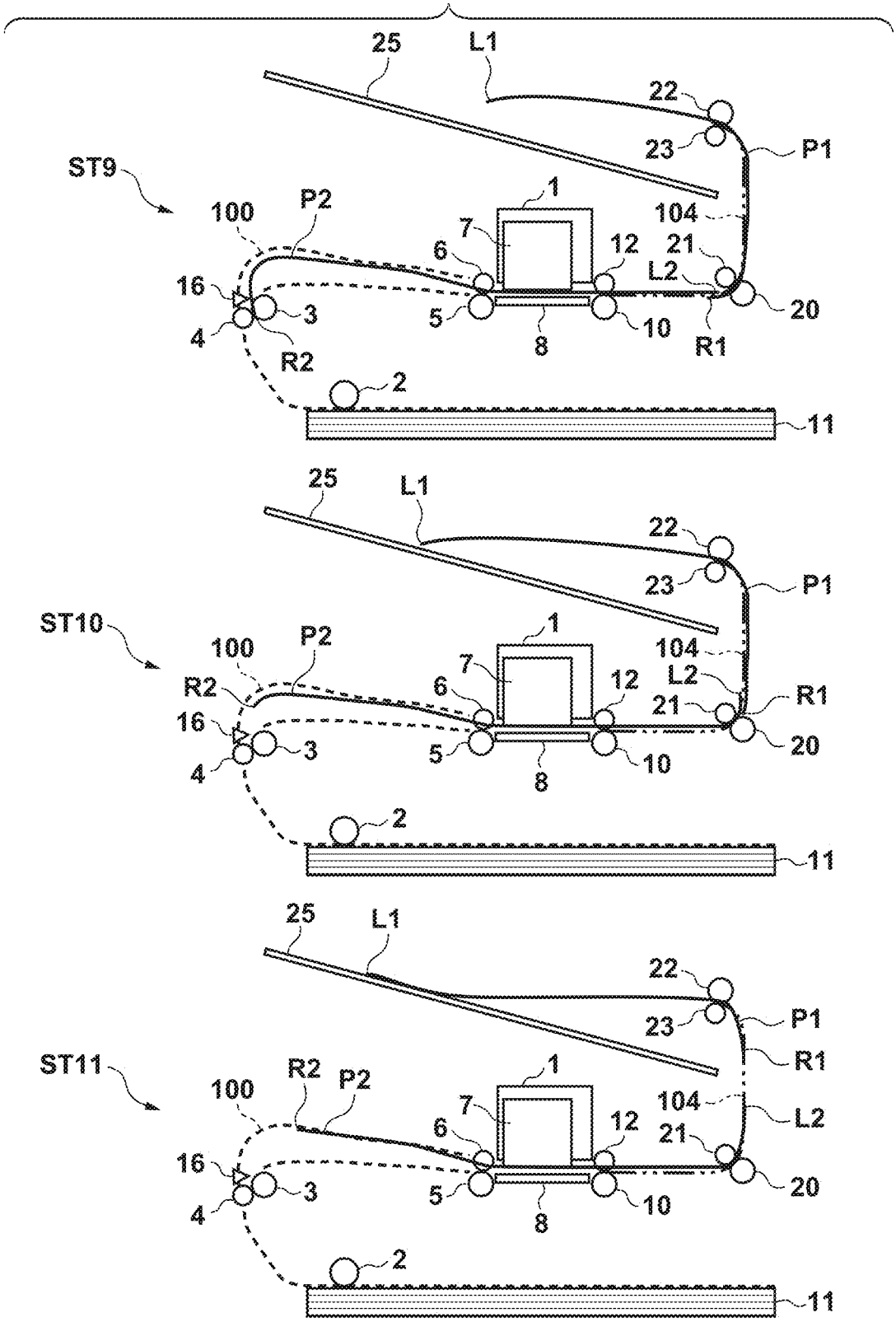
FIG. 8 is a view for explaining the operation of the printing apparatus in FIG. 1.
Figure 9:
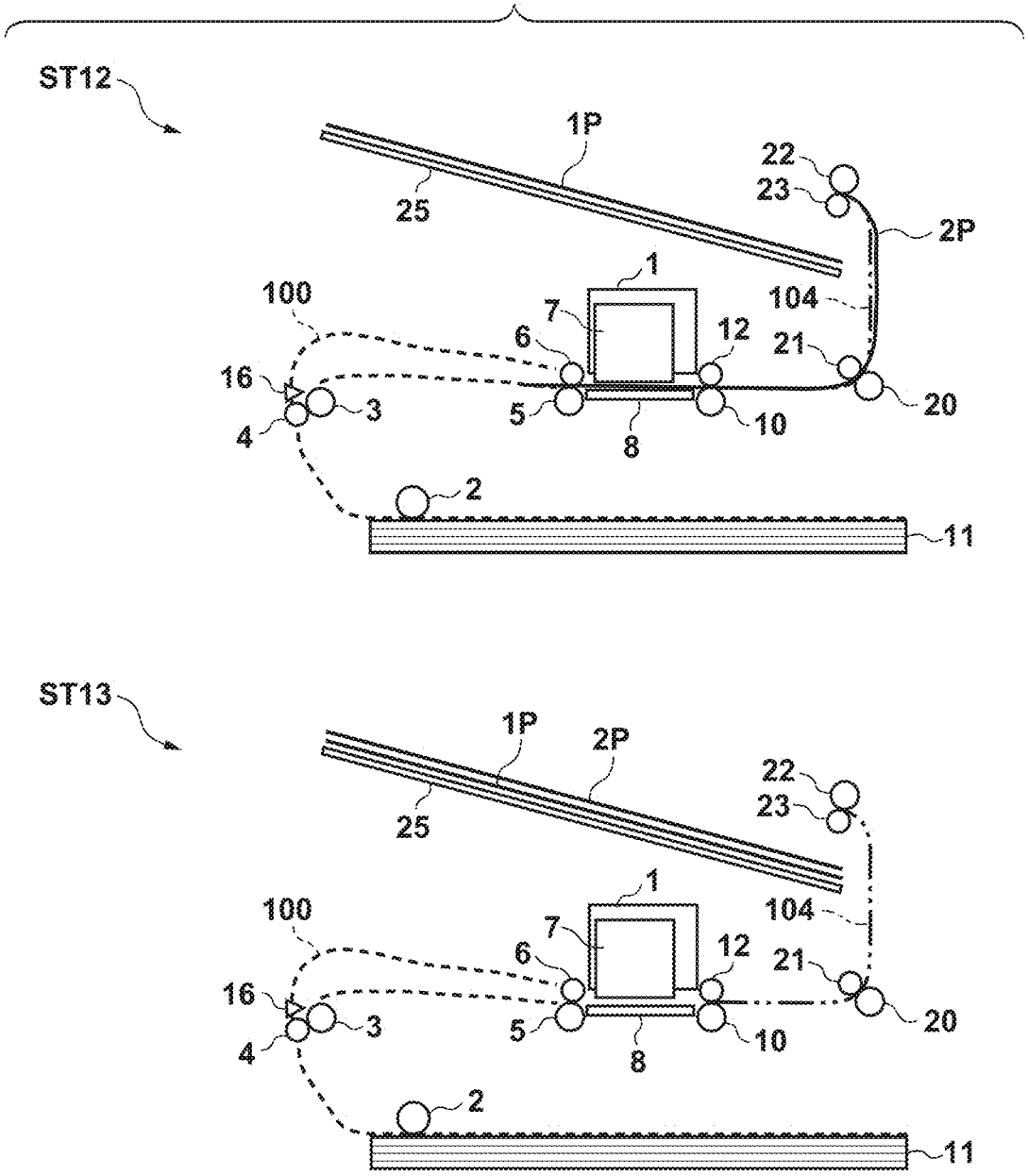
FIG. 9 is a view for explaining the operation of the printing apparatus in FIG. 1.

Referring to FIGS. 7 to 9, as indicated by ST8-1, when the trailing end R1 of the preceding print medium P1 and the leading end L2 of the succeeding print medium P2 are positioned in the interval between the conveyance roller 10 and the conveyance roller 20, a separating operation is started. The position of the trailing end R1 is specified from the rotation amount of the conveyance roller 5 from the alignment position of the preceding print medium P1 and the length of the preceding print medium P1. In a case of an overlap state, when the trailing end R1 of the preceding print medium P1 passes through the conveyance roller 10, a trailing end R2 of the succeeding print medium P2 is located in the interval between the conveyance roller 10 and the conveyance roller 20. After it is determined that the trailing end R1 of the preceding print medium P1 has passed through the conveyance roller 10, the conveyance roller 5 and the conveyance roller 10 independently rotate, and the motor 206 continuously rotates the conveyance roller 20. At this time, the conveying speed of the preceding print medium P1 (the rotational speed of the conveyance roller 20) is controlled to reduce the overlap amount between the succeeding print medium P2 and the preceding print medium P1. Note that the motor 215 also rotates the discharge roller 22 at the same speed as that of the conveyance roller 20. A method of calculating the speed values of the conveyance roller 20 and the discharge roller 22 will be described in detail later.

As indicated by ST8-2 in FIG. 7, the trailing end R1 of the preceding print medium P1 passes through the conveyance roller 20 earlier than the leading end L2 of the succeeding print medium P2, and an interval is formed between the trailing end R1 of the preceding print medium P1 and the leading end L2 of the succeeding print medium P2. If this interval corresponds to a predetermined distance, the discharge roller 22 continuously rotates independently of the conveyance roller 5 and the conveyance roller 10 to discharge the preceding print medium P1. The rotational speed of the conveyance roller 20 is returned to the same rotational speed as that of the conveyance roller 5 and the conveyance roller 10 before the leading end L2 of the succeeding print medium P2 reaches the conveyance roller 20.

In this manner, the preceding print medium P1 and the succeeding print medium P2 can be separated from each other in the interval between the conveyance roller 10 and the conveyance roller 20, thereby canceling the overlap state between the preceding print medium P1 and the succeeding print medium P2. Note that when the overlap state is to be canceled, the rotational speed of the conveyance roller 20 may be higher than that of the conveyance roller 5, but the rotational speed of the conveyance roller 20 need not always be higher than that of the conveyance roller 5. When the conveyance roller 5 performs an intermittent conveying operation for a printing operation for the succeeding print medium P2, since there is a conveyance stop time between printing scan operations, more time is required for the leading end L2 of the succeeding print medium P2 to reach the conveyance roller 20 than when the print media are continuously conveyed. Accordingly, even if the rotational speed of the conveyance roller 20 is the same as that of the conveyance roller 5, continuously rotating the conveyance roller 20 can generate a speed difference between the preceding print medium P1 and the succeeding print medium P2. As described above, performing a separating operation during a printing operation for the succeeding print medium P2 in this manner makes it possible to reduce the conveying speed of the preceding print medium P1 and suppress increases in noise, power consumption, and the like.

In contrast to the above, a separating operation for the preceding print medium P1 and the succeeding print medium P2 is not sometimes completed in the interval between the conveyance roller 10 and the conveyance roller 20 depending on printing conditions. ST9 in FIG. 8 shows an example of such case. Although the overlap amount between the preceding print medium P1 and the succeeding print medium P2 has decreased, the leading end L2 of the succeeding print medium P2 reaches the conveyance roller 20 before the trailing end R1 of the preceding print medium P1 passes through the conveyance roller 20. In a case where the leading end L2 of the succeeding print medium P2 reaches the conveyance roller 20 before the trailing end R1 of the preceding print medium P1 in this manner, the conveying speed of the preceding print medium P1 is adjusted according to the conveying speed of the succeeding print medium P2 so as to synchronously convey the print media. More specifically, the conveyance roller 20 and the discharge roller 22 rotate synchronously with the conveyance roller 5 and the conveyance roller 10. The same applies to a case where the interval between the trailing end R1 of the preceding print medium P1 and the leading end L2 of the succeeding print medium P2 differs from the predetermined distance. The conveying speed of the preceding print medium P1 is adjusted to that of the succeeding print medium P2 before the leading end L2 of the succeeding print medium P2 reaches the conveyance roller 20.

In ST10 in FIG. 8, the trailing end R1 of the preceding print medium P1 has passed through the conveyance roller 20, and the trailing end R1 of the preceding print medium P1 and the leading end L2 of the succeeding print medium P2 are positioned in the interval between the conveyance roller 20 and the discharge driven roller 23. The motor 215 continuously rotates the discharge roller 22 to perform a separating operation for the preceding print medium P1 and the succeeding print medium P2. The conveying speed of the preceding print medium P1 is controlled to set the interval between the leading end L2 of the succeeding print medium P2 and the trailing end R1 of the preceding print medium P1 to a predetermined distance or more before the leading end L2 of the succeeding print medium P2 reaches the discharge roller 22. More specifically, the rotational speed of the discharge roller 22 is controlled. In ST11 in FIG. 8, the preceding print medium P1 and the succeeding print medium P2 can be separated from each other to cancel the overlap state between the preceding print medium P1 and the succeeding print medium P2. A method of calculating the rotational speed value of the discharge roller 22 will be described in detail later with reference to the control procedure.

The preceding print medium P1 and the succeeding print medium P2 can be separated from each other in the interval between the conveyance roller 20 and the discharge roller 22 in this manner to cancel the overlap state between the preceding print medium P1 and the succeeding print medium P2. Note that when the overlap state is to be canceled, the rotational speed of the discharge roller 22 may be set to be higher than that of the conveyance roller 20, but the rotational speed of the discharge roller 22 need not always be higher than that of the conveyance roller 20. When the conveyance roller 20 performs an intermittent conveying operation for a printing operation for the succeeding print medium P2, there is a conveyance stop time between printing scan operations, and more time is required for the leading end L2 of the succeeding print medium P2 to reach the discharge roller 22 than when the print media are consecutively conveyed. Accordingly, even if the rotational speed of the discharge roller 22 is the same as that of the conveyance roller 20, continuously rotating the discharge roller 22 can generate a speed difference between the preceding print medium P1 and the succeeding print medium P2. Performing a separating operation during a printing operation for the succeeding print medium P2 makes it possible to reduce the conveying speed of the preceding print medium P1 and suppress increases in noise, power consumption, and the like.

Referring to ST12 in FIG. 9, since printing on the preceding print medium P1 is completed, the discharge roller 22 is rotated to discharge the preceding print medium P onto the discharge unit 25. Referring to ST13 in FIG. 9, when a printing scan operation for the last line of the succeeding print medium P2 is completed, printing on the succeeding print medium P2 as the last print medium within one job is completed. In this case, rotating the discharge roller 22, the conveyance roller 20, the conveyance roller 10, and the conveyance roller 5 in the same direction will discharge the succeeding print medium P2 onto the discharge unit 25, thereby completing the job.

<Description of Control Procedure>

An example of processing by the MPU 201 will be described. FIGS. 10 to 14 are flowcharts for printing control processing executed by the MPU 201. Letting N be a variable indicating a printing order and K be a page, M indicating the number of print media P is expressed as K(N) and M(N), each as a function of N. Nmax represents a maximum printing order. When print data is transmitted from the host computer 214 via the I/F unit 213, the processing in FIGS. 10A and 10B starts.

Figure 10A:
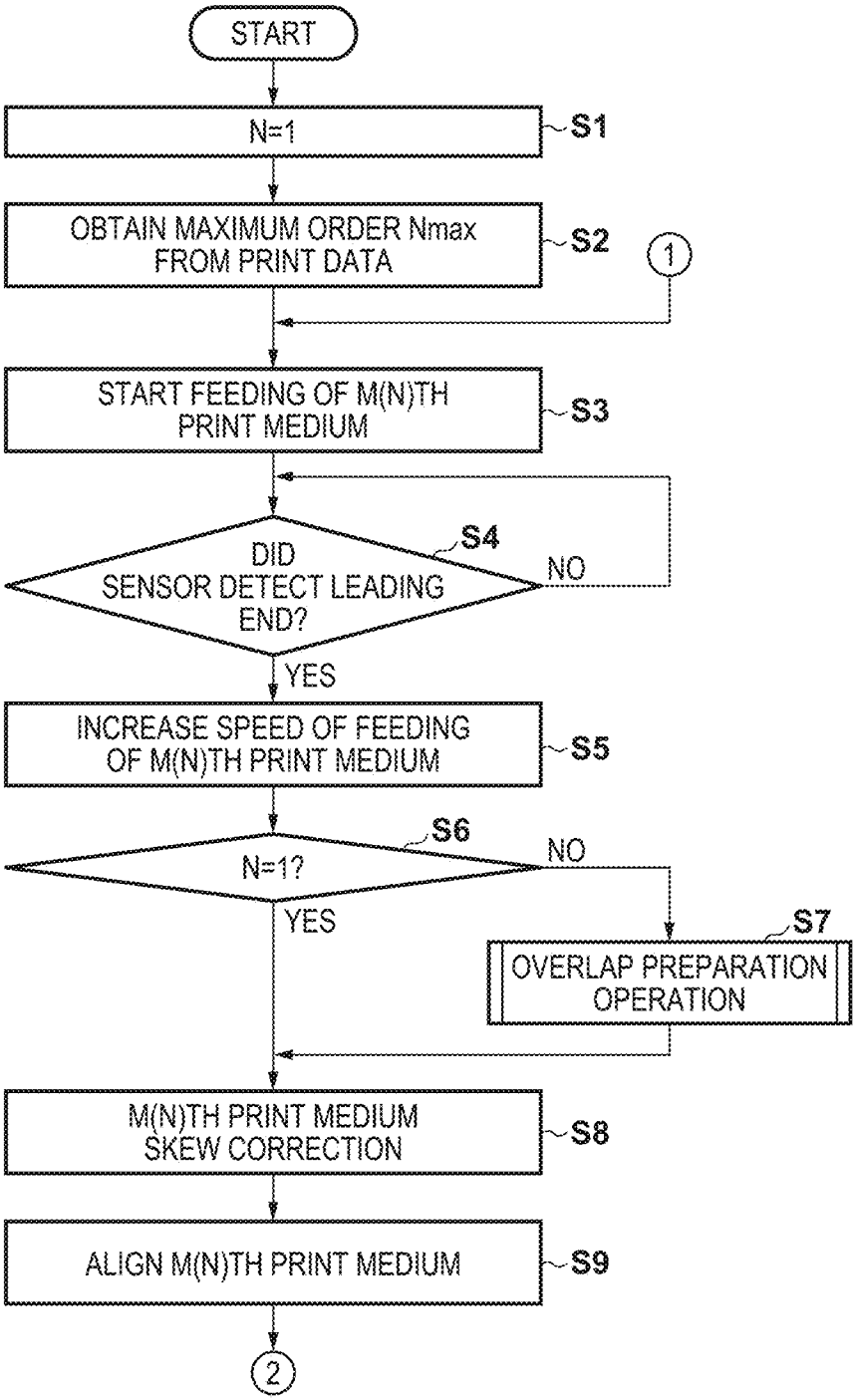
FIGS. 10A and 10B are a flowcharts showing an example of control of the printing apparatus in FIG. 1

In step S1 in FIG. 10A, printing order N=1 is set and initialized. In step S2, the maximum printing order Nmax is obtained from the print data. In step S3, feeding of the M(N)th print medium P from the stacking unit 11 is started at 7.6 inches/sec. First of all, the motor 207 is driven at a low speed. This rotates the pickup roller 2 at 7.6 inches/sec. When the pickup roller 2 rotates, the uppermost print medium P stacked on the stacking unit 11 is picked up. The print medium P picked up by the pickup roller 2 is conveyed by the feed roller 3 rotating in the same direction as that of the pickup roller 2. The motor 208 drives the feed roller 3 at the same speed as that of the pickup roller 2. The pickup roller 2 rotates by a predetermined amount that allows conveyance of the print medium P to a position exceeding the feed roller 3 and then stops so as not to pick up the next print medium P. The pickup roller 2 is a one-way roller. Even if the pickup roller 2 is stopped, conveyance by the feed roller 3 can be continued.

In step S4, it is determined whether the detection sensor 16 has detected the passage of the leading end of the M(N)th print medium P. If it is determined that the leading end has not passed (step S4: NO), the processing in step S4 is repeated. If it is determined that the leading end has passed (step S4: YES), step S6 is executed.

In step S5, the conveying speed of the M(N)th print medium P is switched to 20 inches/sec. At this time, when the motor 208 is switched to high-speed driving, the feed roller 3 rotates at 20 inches/sec. If there is the M(N−1)th print medium P (preceding print medium), this operation is performed to catch up with the print medium.

In step S6, it is determined whether N=1. If it is determined that N=1 (step S6: YES), there is no preceding print medium P on which another print medium is to be overlapped, the process advances to step S8. In contrast, if it is determined that N≠1 (step S6: NO), since it is possible to perform an overlapping operation, an overlap preparation operation in step S7 is executed.

Figure 11:
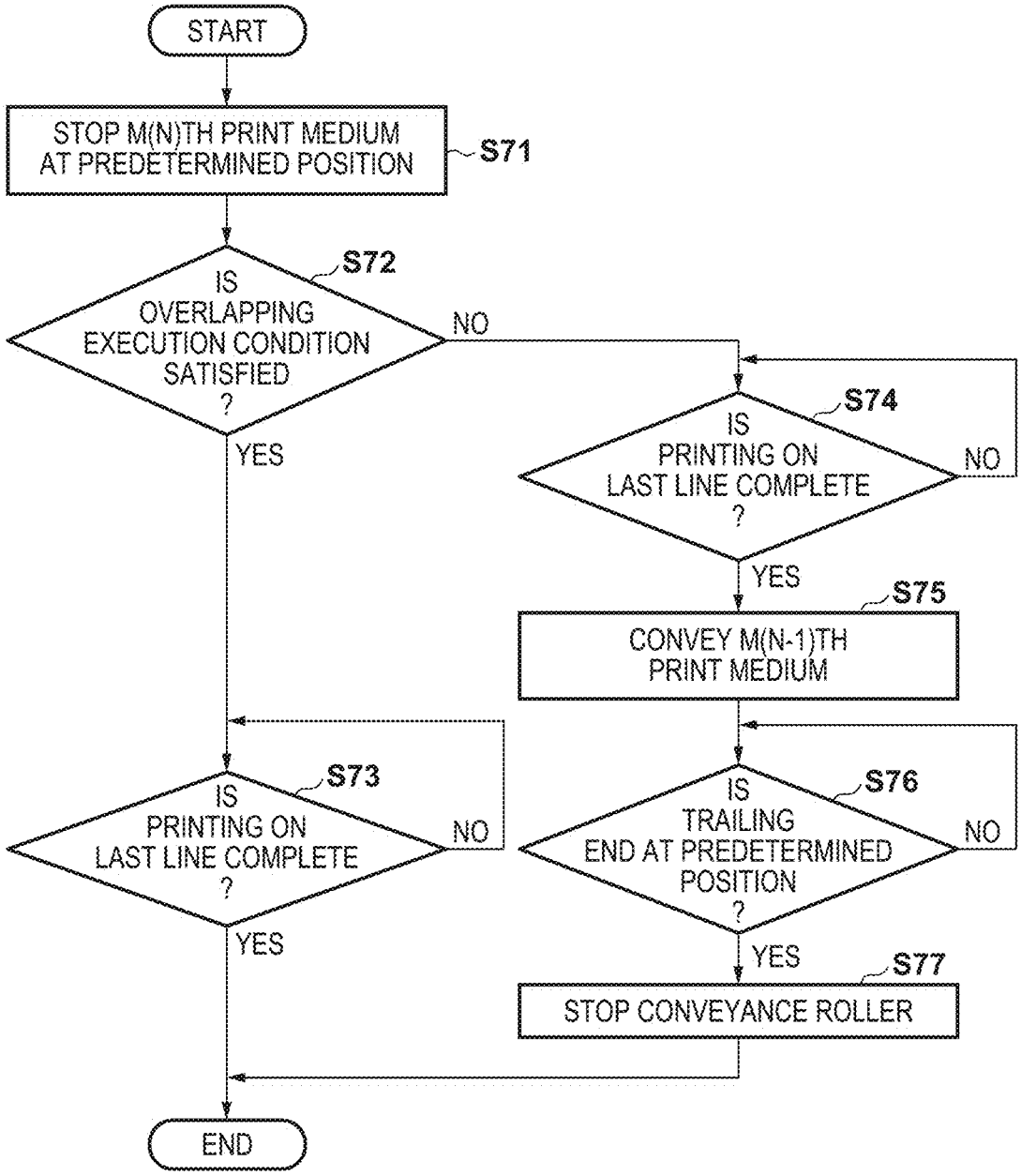
FIG. 11 is a flowchart showing an example of control of the printing apparatus in FIG. 1

FIG. 11 is a flowchart showing an example of processing for the overlapping preparation operation in step S7 in FIG. 11. Assume that step S71 is executed, and the leading end of the M(N)th print medium P reaches a predetermined position before the conveyance roller 5. In this case, the conveyance is stopped. The position of the leading end of the M(N)th print medium P is calculated from the rotation amount of the feed roller 3 from when the leading end of the M(N)th print medium P is detected by the detection sensor 16 and controlled based on the calculation result.

In step S72, it is determined whether a predetermined overlapping execution condition is satisfied. The details of the overlapping execution condition will be described later. If it is determined that the overlapping execution condition is satisfied (step S72: YES), step S73 is executed. In step S73, it is determined whether a printing scan operation for the last line of the M(N−1)th print medium P is started. If it is determined that the printing scan operation is not started (step S73: NO), the processing in step S73 is repeated. If it is determined that the printing scan operation is started (step S73: YES), the processing is terminated. Subsequently, step S8 in FIG. 10A is executed.

In contrast, if it is determined in step S72 that the overlapping execution condition is not satisfied (step S72: NO), step S74 is executed. Sequentially executing steps S74 to S77 can perform an operation of canceling the overlap state or an operation to be performed when the succeeding print medium P has not been able to sufficiently catch up with the preceding print medium P.

In step S74, it is determined whether printing on the last line of the M(N−1)th print medium P is completed. If it is determined that the printing is not completed (step S74: NO), the processing in step S74 is repeated. If it is determined that the printing is completed (step S74: YES), step S75 is executed to convey the M(N−1)th print medium P at 18 inches/sec by using the conveyance roller 5.

In step S76, it is determined whether the trailing end of the M(N−1)th print medium P has been conveyed by a predetermined amount or more upon passing through the conveyance roller 5. If it is determined that the print medium has not been conveyed by the predetermined amount or more (step S76: NO), the processing in step S76 is repeated. If it is determined that the print medium has been conveyed by the predetermined amount or more (step S76: YES), step S77 is executed, and the conveyance roller 5 is stopped. The processing is terminated, and step S8 in FIG. 10A is then executed.

Sequentially executing steps S74 to S77 described above makes it possible to cancel the overlap state at a position upstream of the conveyance roller 5 in the conveying direction if the overlapping execution condition is not satisfied after the overlap state is formed. If the succeeding M(N)th print medium P has not sufficiently caught up with the M(N−1)th print medium P, it is possible to perform preparation for solely performing skew correction of the M(N)th print medium P.

Referring to FIG. 10A, in step S8, skew correction is performed for the M(N)th print medium P. Driving the feed roller 3 while stopping the conveyance roller 5 will cause the leading end of the M(N)th print medium P to abut against the nip portion between the conveyance roller 5 and the pinch roller 6, thereby correcting the skew of the M(N)th print medium P. At this time, if it is determined in step S7 that N=1 (step S7: YES), skew correction is performed for the M(N)th print medium P in an alone state in which it does not overlap with the preceding print medium P. In addition, if it is determined in step S72 that the overlapping execution condition is satisfied (step S72: YES), skew correction is performed for the M(N)th print medium P in an overlap state with the M(N−1)th print medium P. In contrast to this, if it is determined in step S72 that the overlapping execution condition is not satisfied (step S72: NO), skew correction is performed for the M(N)th print medium P in an alone state in which it does not overlap with the preceding print medium P.

In step S9, the M(N)th print medium P is aligned. Rotating the conveyance roller 5 by a predetermined amount makes it possible to align the M(N)th print medium P. At this time, if the M(N)th print medium P has undergone skew correction in an overlap state with the M(N−1)th print medium P in step S8, the M(N)th print medium P is aligned while the overlap state is maintained. That is, both the M(N)th print medium P and the M(N−1)th print medium P are simultaneously conveyed in the overlap state.

In step S10, the conveying speed of the M(N)th print medium P is switched to 7.6 inches/sec. Switching the motor 208 to low-speed driving will rotate the feed roller 3 at 7.6 inches/sec. In step S11, a printing operation based on the data of the K(N)th page of the M(N)th print medium P is started. While the conveyance roller 5 intermittently conveys the M(N)th print medium P by a predetermined amount at a time, the motor 208 also intermittently drives the feed roller 3. When the M(N)th print medium P is intermittently conveyed for a printing operation, the M(N−1)th print medium P is also intermittently conveyed.

It is determined in step S12 whether N=1. If N=1 (step S12: YES), step S13 is executed. In contrast to this, if it is determined that N≠1 (step S12: NO), step S16 is executed.

In step S16, it is determined whether the M(N−1)th print medium P and the M(N)th print medium P are in an overlap state. If it is determined that the print media are in the overlap state (step S16: YES), the separating operation in step S17 is executed. The separating operation will be described in detail later. After the execution of step S17, the discharging operation in step S18 is executed. In step S18, the M(N−1)th print medium P is discharged onto the discharge unit 25 by the rotation of the discharge roller 22 and the conveyance roller 20. If it is determined that the print media are not in the overlap state (step S16: NO), the separating operation in step S17 is not executed, but the discharging operation in step S18 is executed.

In step S13, the printing order N is incremented. That is, printing order N=N+1 is set. In step S14, it is determined whether the printing order N is equal to or less than the maximum printing order Nmax. If it is determined that the printing order N is equal to or less than the maximum printing order Nmax (step S14: YES), step S15 is executed. In step S15, it is determined whether the detection sensor 16 has detected the passage of the trailing end of the M(N−1)th print medium P. If it is determined that the detection sensor 16 has detected the passage (step S15: YES), the process returns to step S3 to repeat similar processing.

In contrast, if it is determined in step S14 that the printing order N is not equal to or less than the maximum printing order Nmax (step S14: NO), it is determined that printing on the last line is completed, and step S19 is executed. In step S19, the M(N−1)th print medium P is discharged. Rotating the discharge roller 22, the conveyance roller 20, the conveyance roller 10, and the conveyance roller 5 in the same direction makes it possible to discharge the M(N−1)th print medium P onto the discharge unit 25. When the discharging of the print medium is completed, the processing is terminated.

<Overlapping Execution Condition>

Figure 12:
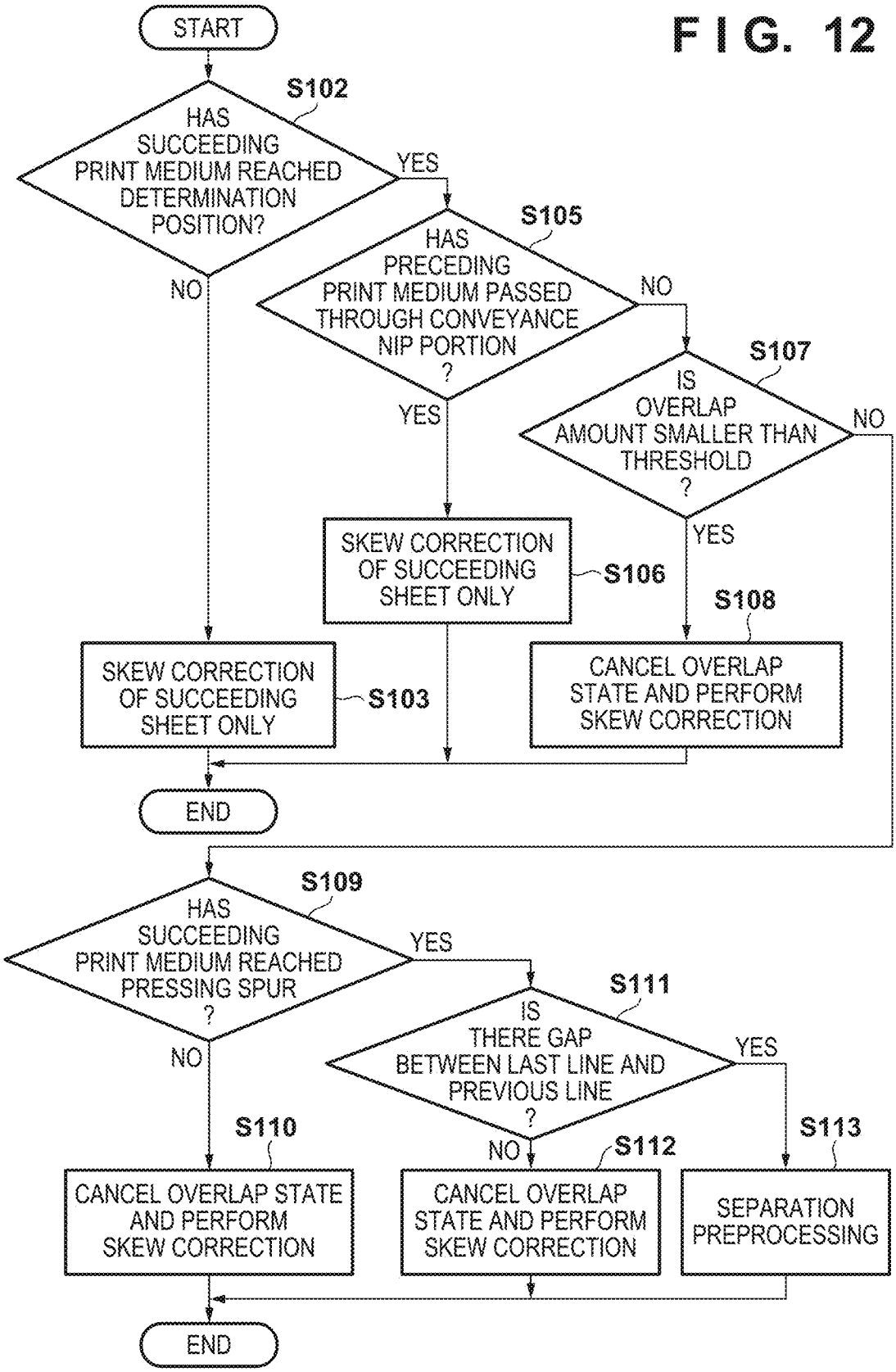
FIG. 12 is a flowchart showing an example of control of the printing apparatus in FIG. 1

FIG. 12 is a flowchart showing an example of processing associated with determination of whether the overlapping execution condition described concerning step S72 in FIG. 11 is satisfied. The mode of a skew correcting operation for the print medium P is selected based on this determination. Assume that the M(N−1)th print medium P is the preceding print medium P1, and the M(N)th print medium P is the succeeding print medium P2.

In step S102, it is determined whether the leading end of the succeeding print medium P2 has reached a determination position (PS3 in ST5-1 in FIG. 5). If the leading end has not reached the determination position (step S102: NO), it is not clear that a predetermined amount of conveyance will cause the leading end of the succeeding print medium P2 to abut against the nip portion between the conveyance roller 5 and the pinch roller 6. Accordingly, it is decided to perform a skew correcting operation for the succeeding print medium P2 in an alone state in which it does not overlap (step S103). That is, after the trailing end of the preceding print medium P1 passes through the nip portion between the conveyance roller 5 and the pinch roller 6, only the succeeding print medium P is made to abut against the nip portion to perform a skew correcting operation. Subsequently, the succeeding print medium P is aligned.

If the leading end of the succeeding print medium P2 has reached the determination position PS3 (step S102: YES), it is determined whether the trailing end of the preceding print medium P1 has passed through the nip portion between the conveyance roller 5 and the pinch roller 6 (step S105). If it is determined that the trailing end has passed through the nip portion (step S105: YES), the preceding print medium P1 and the succeeding print medium P2 are not in the overlap state. Accordingly, it is decided to perform a skew correcting operation for the succeeding print medium in an alone state in which it does not overlap (step S106). That is, a skew correcting operation is performed by causing the leading end of the succeeding print medium P2 to abut against the nip portion between the conveyance roller 5 and the pinch roller 6. Thereafter, the succeeding print medium P is aligned.

If it is determined that the trailing end of the preceding print medium P has not passed through the nip portion between the conveyance roller 5 and the pinch roller 6 (step S105: NO), the process advances to step S107. In step S107, it is determined whether the overlap amount between the trailing end of the preceding print medium P1 and the succeeding print medium P2 is smaller than a threshold. The position of the trailing end of the preceding print medium P1 is updated accompanying a printing operation for the preceding print medium P1. The leading end of the succeeding print medium P2 is positioned at the determination position described above.

That is, the overlap amount decreases accompanying the printing operation for the preceding print medium P1. If it is determined that the overlap amount is smaller than the threshold (step S107: YES), it is decided to perform a skew correcting operation for the succeeding print medium P2 in an alone state upon canceling the overlap state (step S108). In this case, the succeeding print medium P2 is not conveyed together with the preceding print medium P1. More specifically, the motor 205 drives the conveyance roller 5 to convey the preceding print medium P1. However, the feed roller 3 is not driven. Accordingly, the overlap state is canceled. In addition, a skew correcting operation is performed by causing only the succeeding print medium P2 to abut against the nip portion. Thereafter, the succeeding print medium P is aligned.

If it is determined that the overlap amount is equal to or more than the threshold (step S107: NO), it is determined whether the succeeding print medium P reaches the spur (not shown) when the succeeding print medium P2 is aligned (step S109). The spur (not shown) is a spur that rotates upon coming into contact with the printing surface of the print medium P having undergone printing by the printhead 7 and is located upstream of the spur 12 in the conveying direction.

If it is determined that the succeeding print medium P2 does not reach the spur (not shown) (step S109: NO), it is decided to perform a skew correcting operation for the succeeding print medium P2 in an alone state upon canceling the overlap state (step S110). That is, the succeeding print medium P2 is not conveyed together with the preceding print medium P. More specifically, the motor 205 drives the conveyance roller 5 to convey the preceding print medium P1. However, the feed roller 3 is not driven. Accordingly, the overlap state is canceled. In addition, a skew correcting operation is performed by causing the leading end of the succeeding print medium P2 to abut against the nip portion between the conveyance roller 5 and the pinch roller 6. Thereafter, the succeeding print medium P is aligned.

If it is determined that the succeeding print medium P reaches the spur (not shown) (step S109: YES), it is determined whether there is a gap between the last line of the preceding print medium P1 and a line preceding the last line (step S111). If it is determined that there is no gap (step S111: NO), it is decided to perform a skew correcting operation for the succeeding print medium in an alone state upon canceling the overlap state (step S112). If it is determined that there is a gap (step S111: YES), the separation preprocessing in step S113 shown in FIG. 13 is executed.

<Separation Preprocessing>

Figure 13:
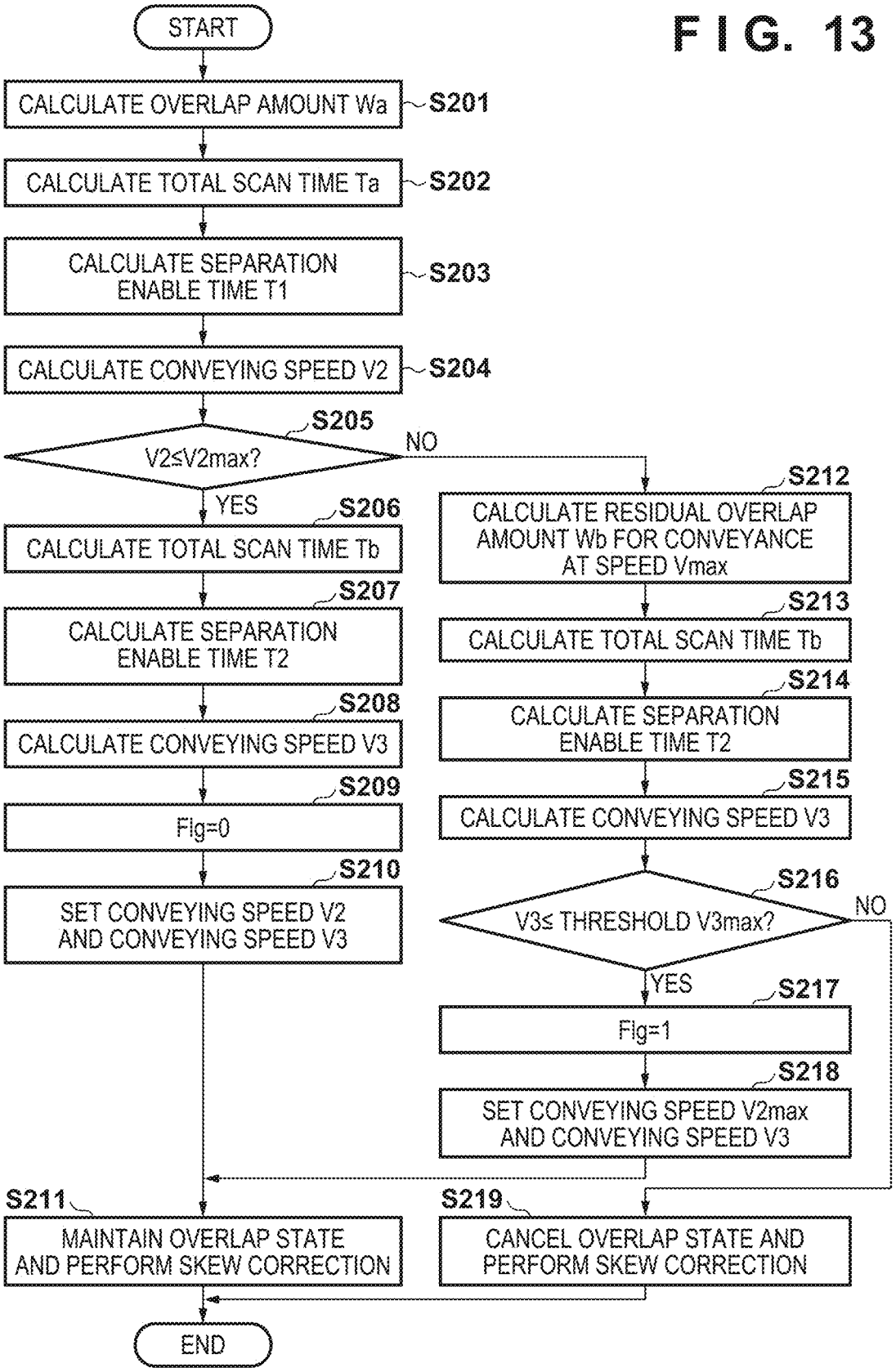
FIG. 13 is a flowchart showing an example of control of the printing apparatus in FIG. 1

FIG. 13 is a control flowchart for separation preprocessing in step S113. FIGS. 14A to 15D are conceptual diagrams expressing the relationship between variables (to be described later). In this embodiment, speed setting in a separating operation is performed in advance before the completion of a printing operation on the preceding print medium P1, in particular, in the stage of determination of whether to execute a skew correcting operation for the succeeding print medium P2.

Figure 14A:
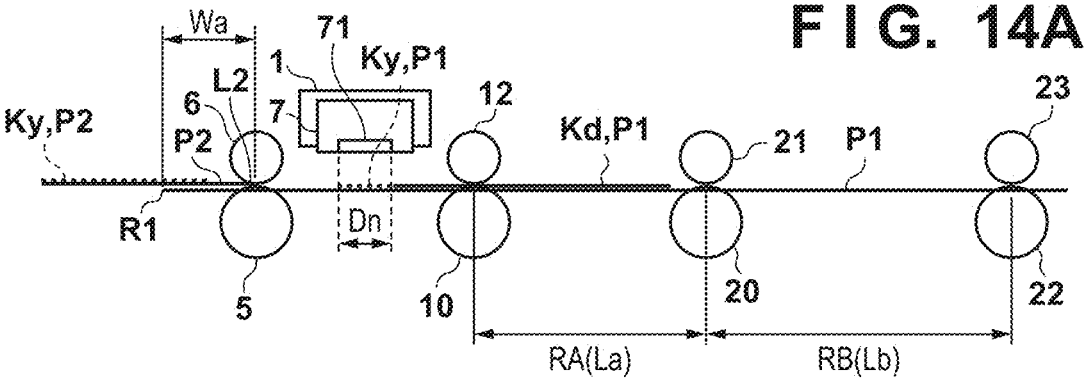
FIGS. 14A to 14D are views for explaining a separating operation.

In step S201, an overlap amount Wa is calculated. The overlap amount Wa corresponds to the distance (planned distance) in the conveying direction by which the preceding print medium P1 and the succeeding print medium P2 overlap each other and also corresponds to the distance from the conveyance roller 5 to the trailing end of the preceding print medium P1. In this embodiment, as shown in FIG. 14A, when a skew correcting operation is to be performed for the succeeding print medium P2, the leading end of the succeeding print medium P2 is caused to abut against the conveyance nip portion when the conveyance roller 5 is stopped for the execution of a printing scan operation on the last line of the preceding print medium P1. At this time, the preceding print medium P1 and the succeeding print medium P2 overlap each other by the overlap amount Wa.

Referring to FIG. 14A, Ky represents a planned printing region on the print medium P, Kd represents a printed region, and Dn represents the distance of a nozzle region and the distance of the region from the most upstream to the most downstream of a discharge nozzle 71 of the printhead 7, that is, the maximum printing width of the printhead 7. Letting Ds be a printing width in one printing scan operation, Ds≤Dn. Note that a printing width D2 may not be constant and differ for each printing scan operation. Let La be the distance of an interval (conveyance interval) RA between the conveyance roller 10 and the conveyance roller 20 and Lb be the distance of an interval (conveyance interval) RB between the conveyance roller 20 and the discharge roller 22.

In step S202, a total scan time Ta is calculated. The total scan time Ta is the total time of a printing scan operation for the succeeding print medium P2 which is performed while the leading end L2 of the succeeding print medium P2 moves a determination distance LA. For example, assuming that a printing scan operation is performed 10 times for the succeeding print medium P2 while the leading end L2 of the succeeding print medium P2 passes through the determination distance LA, and the time taken for each operation is 2 sec, the total scan time Ta is 20 sec. The total scan time Ta is the value (estimated value) calculated in advance from the print data of the succeeding print medium P2.

Figure 14B:
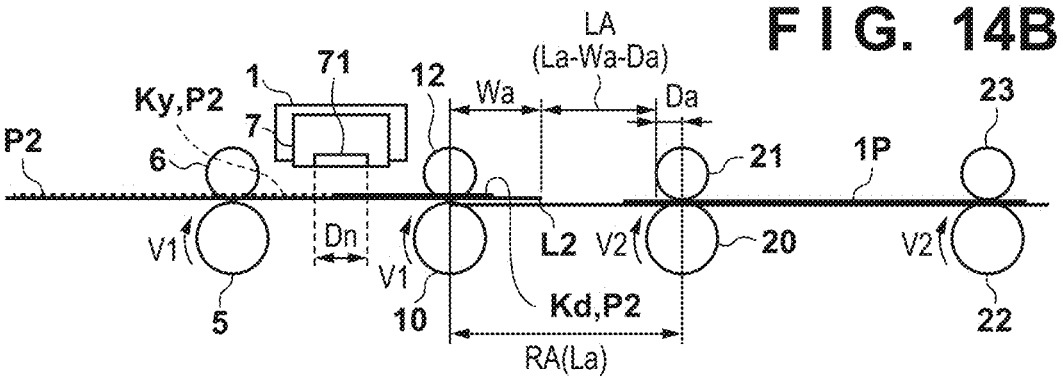

In this embodiment, as shown in FIG. 14B, after the trailing end R1 of the preceding print medium P1 passes through the conveyance roller 10, a separating operation is started. Note that the start timing is not limited to the timing immediately after the passage and may be a timing after the passage. Assume that Da (>0) represents the necessary interval between the trailing end R1 of the preceding print medium P1 and the leading end L2 of the succeeding print medium P2 after the separating operation. A separating operation is executed so as to be completed until the trailing end R1 of the preceding print medium P1 passes through a position spaced upstream from the conveyance roller 20 by the interval Da in the conveying direction. The determination distance LA is calculated according to LA=La−Wa−Da.

In step S203 in FIG. 13, a separation enable time T1 is calculated. A separating operation in an interval RA cannot be performed after the succeeding print medium P2 reaches the conveyance roller 20. The separation enable time T1 is the execution time of reduction control in the interval RA and is also an allowed time for separating the preceding print medium P1 and the succeeding print medium P2 from each other by providing a conveyance speed difference between them. The separation enable time T1 is estimated from the sum of the time to convey the succeeding print medium P2 by the determination distance LA and the total time of a printing scan operation for the succeeding print medium P2. The separation enable time T1 is expressed as $$T1 = (La - Wa - Da)/V1 + Ta$$

where V1 is the conveying speed of the succeeding print medium P2. Referring to FIGS. 14B to 15D, for the convenience of easy understanding, the conveying speed V1 is notated as the rotational speed of the conveyance rollers 5 and 10. However, the conveying speed V1 is used as the moving speed of the succeeding print medium P2. The rotational speed of the conveyance rollers 5 and 10 is set based on the conveying speed V1. The same applies to a conveying speed V2 to be described later.

In step S204 in FIG. 13, the conveying speed (speed value) V2 of the preceding print medium P1 at the time of a separating operation in the interval RA is calculated as $$V2 = La/T1$$

As described above, in this embodiment, the conveying speed V2 is a variable value instead of a fixed value. The conveying speed V2 of the preceding print medium P1 is set to a lower speed within the range required to separate the preceding print medium P1 and the succeeding print medium P2 from each other. This makes it possible to suppress increases in noise in the driving system and power consumption.

More specifically, in this embodiment, the separation enable time T1 is calculated based on the print data of the succeeding print medium P2, and the conveying speed V2 is calculated. According to the print data of the succeeding print medium P2, if a printing operation corresponding to the interval RA takes a time, the conveying speed V2 is calculated as a relatively low speed to make it possible to suppress increases in noise in the driving system and power consumption. In contrast to this, according to the print data of the succeeding print medium P2, if a printing operation corresponding to the interval RA takes a short time, the conveying speed V2 is set to a relatively high speed in preference to separation. When, for example, such printing operations based on two different print data are compared with each other, the conveying speed V2 in one operation is relatively low, and the conveying speed V2 in the other operation is relatively high.

In step S205 in FIG. 13, it is determined whether the conveying speed V2 calculated in step S204 is equal to or less than a threshold (upper limit speed) V2max stored in advance in the ROM 202. Setting the upper limit of the conveying speed can suppress increases in noise in the driving system and power consumption. If it is determined that the conveying speed V2 is higher than the threshold V2max (step S205: NO), the process advances to step S212. In contrast to this, if the conveying speed V2 is equal to or less than the threshold V2max (step S205: YES), the process advances to step S206.

Figure 14C:
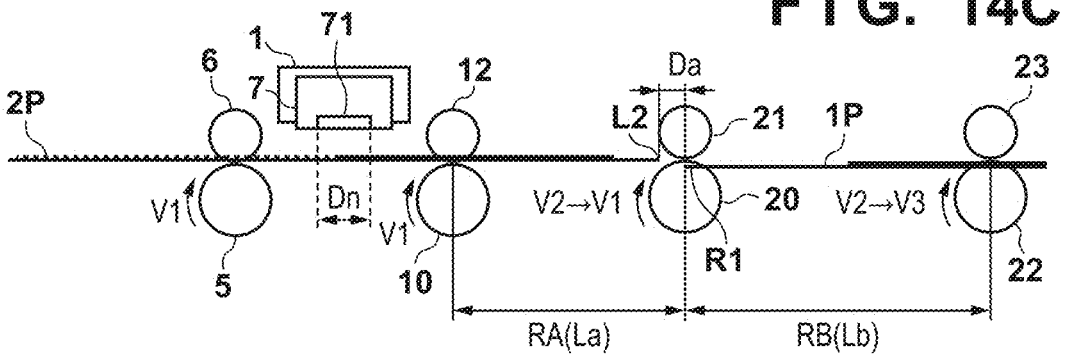

If it is determined in step S205 that the conveying speed V2 is equal to or less than the threshold V2max (step S205: YES), the interval between the preceding print medium P1 and the succeeding print medium P2 becomes Da or more when the trailing end R1 of the preceding print medium P1 passes through the conveyance roller 20. FIG. 14C shows an example of such an operation. That is, separation by the interval Da has been completed. The preceding print medium P1 and the succeeding print medium P2 are further conveyed while this interval is maintained. Accordingly, in step S206, a total scan time Tb is calculated. The total scan time Tb is the total time of a printing scan operation for the succeeding print medium P2 which is performed while the leading end L2 of the succeeding print medium P2 moves a determination distance LB. The total scan time Tb is the value (estimated value) calculated in advance from the print data of the succeeding print medium P2.

Figure 14D:
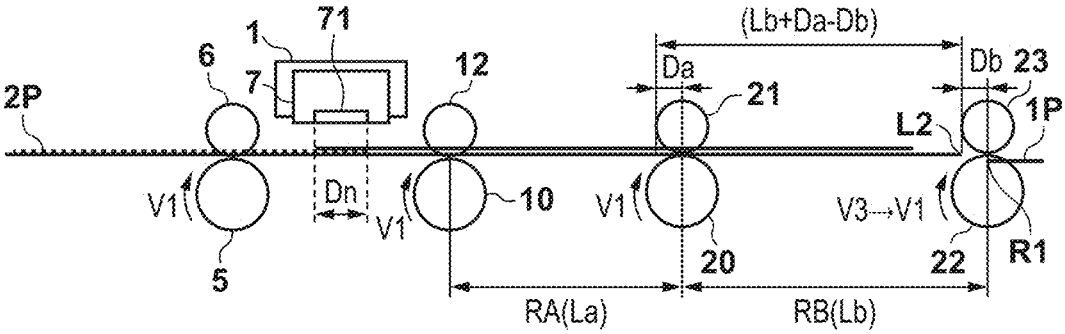

As shown in FIGS. 14C and 14D, even after the trailing end R1 of the preceding print medium P1 passes through the conveyance roller 20, a separating operation is started. Note that the start timing is not limited to a timing immediately after the passage and may be a timing after the passage. Assume that the necessary interval between the trailing end R1 of the preceding print medium P1 and the leading end L2 of the succeeding print medium P2 after a separating operation is Db(>0). The determination distance LB is calculated as $$LB = Lb + Da - Db.$$

In step S207 in FIG. 13, a separation enable time T2 is calculated. Assume that a separating operation in an interval RB is to be completed by the time when the trailing end R1 of the preceding print medium P1 passes through a position spaced upstream from the discharge roller 22 by the interval Db in the conveying direction. The separation enable time T2 is the execution time of reduction control in the interval RB and is also an allowed time for separating the preceding print medium P1 and the succeeding print medium P2 from each other by providing a conveyance speed difference between them. The separation enable time T2 is estimated from the sum of the time to convey the succeeding print medium P2 by the determination distance LB and the total time of a printing scan operation for the succeeding print medium P2. The separation enable time T2 is expressed as $$T2 = (La + Da - Db)/V1 + Tb$$

In step S208 in FIG. 13, a conveying speed (speed value) V3 of the preceding print medium P1 at the time of a separating operation in the interval RB is calculated by $$V3 = Lb/T2$$

In this case as well, the conveying speed V3 of the preceding print medium P1 is set to a lower speed within the range required to separate the preceding print medium P1 and the succeeding print medium P2 from each other. This can suppress increases in noise in the driving system and power consumption.

In step S209 in FIG. 13, separation processing flag Flg=0 is set in the RAM 203. This will reserve the execution of a separating operation. Thereafter, the process advances to step S210. In step S210, the conveying speed V2 calculated in step S204 and the conveying speed V3 calculated in step S208 are saved in the RAM 203. In step S211, a skew correcting operation is executed while the overlap state is maintained.

Figure 15A:
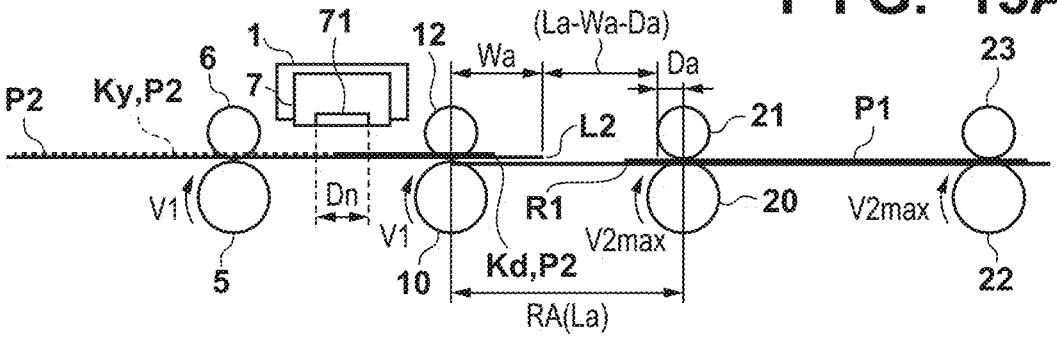
FIGS. 15A to 15D are views for explaining a separating operation.

If it is determined in step S205 in FIG. 13 that the conveying speed V2 is higher than the threshold V2max (step S205: NO), processing in step S212 is executed by simulating a case where the preceding print medium P1 is conveyed by using the conveying speed V2 as the threshold V2. In the interval RA, the separating operation for the preceding print medium P1 and the succeeding print medium P2 is not completed. In step S212, a residual overlap amount Wb is calculated in a case where a separating operation is started and the preceding print medium P1 is conveyed at the conveying speed V2max, as shown in FIG. 15A.

Figure 15B:
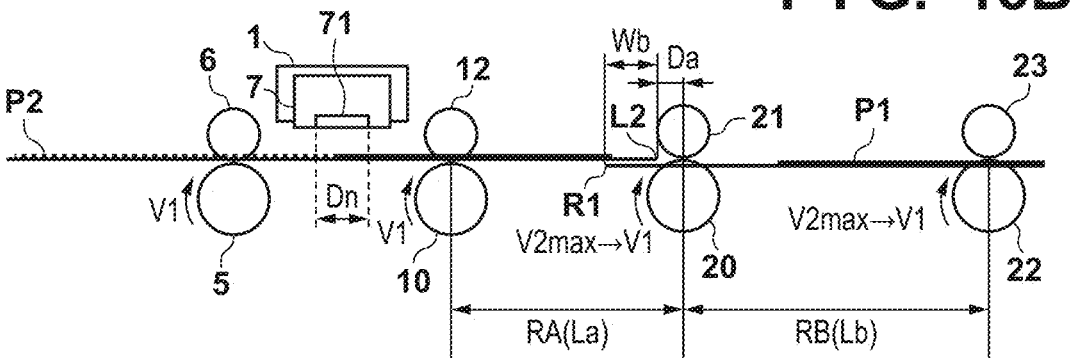

The residual overlap amount Wb will be described with reference to FIG. 15B. When the leading end L2 of the succeeding print medium P2 reaches the front position at the distance Da from the conveyance roller 20, the preceding print medium P1 and the succeeding print medium P2 overlap each other by the overlap amount Wb. The residual overlap amount Wb is smaller than the overlap amount Wa. The residual overlap amount Wb is calculated by $$Wb = Wa - \{V2\max \times T1 - (La - Wa - Da)\}$$

Figure 15C:
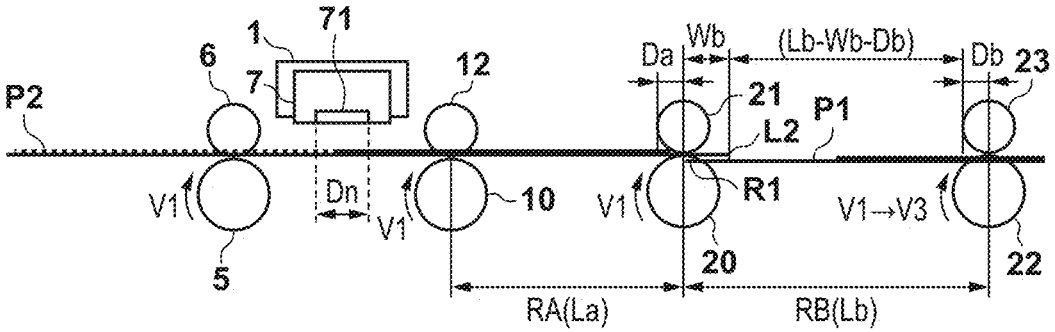

In step S213 in FIG. 13, the total scan time Tb is calculated. The total scan time Tb is the one described with reference to step S206. Note, however, that as shown in FIG. 15C, the determination distance LB is calculated by LB=Lb−Wb−Db. In step S214, the separation enable time T2 is calculated. This operation is the same as that described with reference to step S207. Note, however, that the arithmetic equation in use is $$T2 = (Lb - Wb - Db)/V1 + Tb$$

In step S215, the conveying speed (speed value) V3 of the preceding print medium P1 at the time of a separating operation in the interval RB is calculated by $$V3 = Lb/T2$$

The conveying speed V3 is not a fixed value but is a variable value. Setting the conveying speed V3 to a lower speed within the range required to separate the preceding print medium P1 and the succeeding print medium P2 from each other makes it possible to suppress increases in noise in the driving system and power consumption.

More specifically, in this embodiment, the separation enable time T2 is calculated based on the print data of the succeeding print medium P2, and the conveying speed V3 is calculated. If a printing operation corresponding to the interval RB takes a time according to the print data of the succeeding print medium P2, the conveying speed V3 is calculated as a relatively low speed, thereby making it possible to suppress increases in noise in the driving system and power consumption. In contrast to this, if a printing operation corresponding to the interval RB takes a short time according to the print data of the succeeding print medium P2, the conveying speed V3 is set to a relatively high speed in preference to separation. When, for example, such printing operations based on two different print data are compared with each other, the conveying speed V3 in one operation is relatively low, and the conveying speed V3 in the other operation is relatively high.

In step S216, it is determined whether the conveying speed V3 calculated in step S215 is equal to or less than a threshold (upper limit speed) V3max stored in advance in the ROM 202. If it is determined that the conveying speed V3 is higher than the threshold V3max (step S216: NO), the process advances to step S219. In contrast to this, if the conveying speed V3 is equal to or less than the threshold V3max (step S216: YES), the process advances to step S217.

Figure 15D:
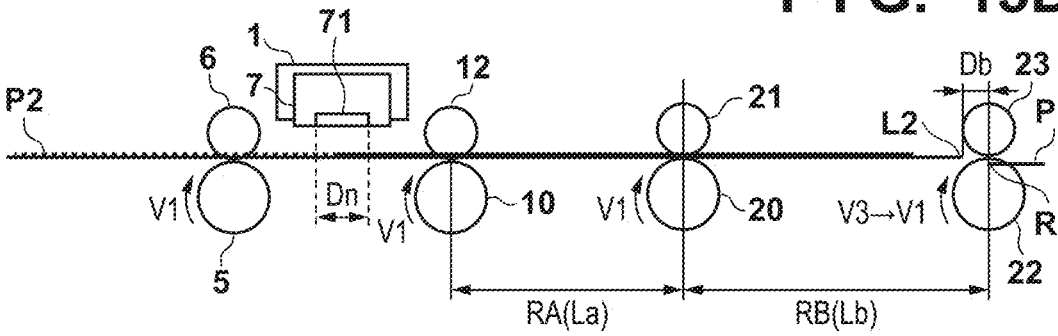

If it is determined in step S216 that the conveying speed V3 is equal to or less than the threshold V3max (step S216: YES), the interval between the preceding print medium P1 and the succeeding print medium P2 is equal to or more than Db when the trailing end R1 of the preceding print medium P1 passes through the discharge roller 22, as shown in FIG. 15D. That is, separation by the interval Db has been completed. In step S217, separation processing flag Flg=1 is set in the RAM 203. This will reserve the execution of a separating operation. In step S218, the threshold V2max as the conveying speed V2 and the conveying speed V3 calculated in step S215 are saved in the RAM 203. In step S211, it is decided to perform a skew correcting operation while maintaining the overlap state.

If it is determined in step S216 that the conveying speed V3 is higher than the threshold V3max (step S216: YES), it is estimated that the trailing end R2 of the preceding print medium P1 does not precede the leading end L2 of the succeeding print medium P2 by Db in the interval RB. This indicates that the preceding print medium P1 cannot be separated from the succeeding print medium P2 by a separating operation. Accordingly, it is decided to perform a skew correcting operation for the succeeding print medium in an alone state upon canceling the overlap state in advance (step S219). Not performing conveyance in an overlap state can prevent a deterioration in discharging performance. The motor 205 drives the conveyance roller 5 to convey the preceding print medium P1. However, the feed roller 3 is not driven. Accordingly, the overlap state is canceled. In addition, the leading end of the succeeding print medium P2 is caused to abut against the nip portion between the conveyance roller 5 and the pinch roller 6 to perform a skew correcting operation. Thereafter, the print medium P is aligned.

<Control Procedure for Separating Operation>

Figure 10B:
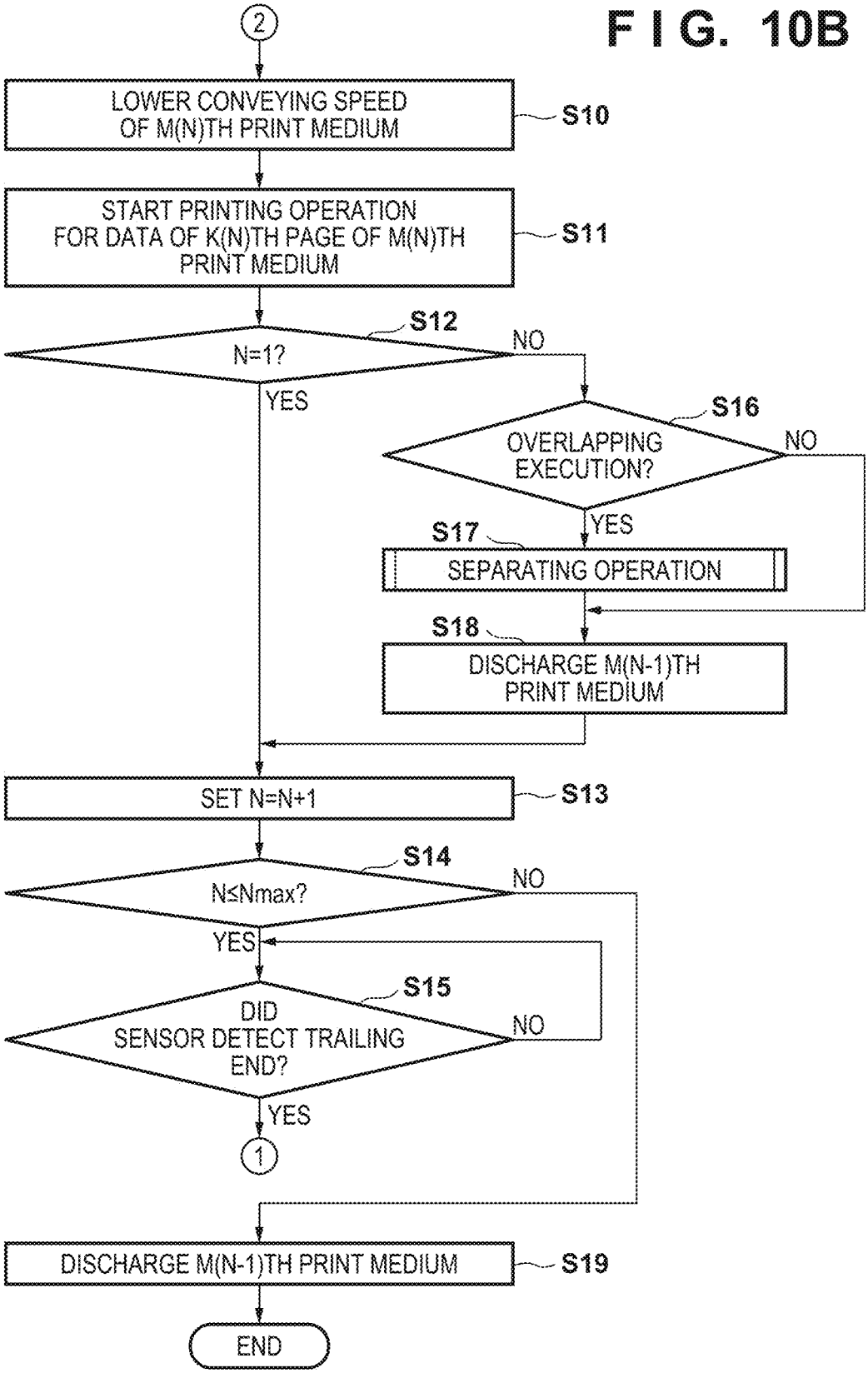
Figure 16:
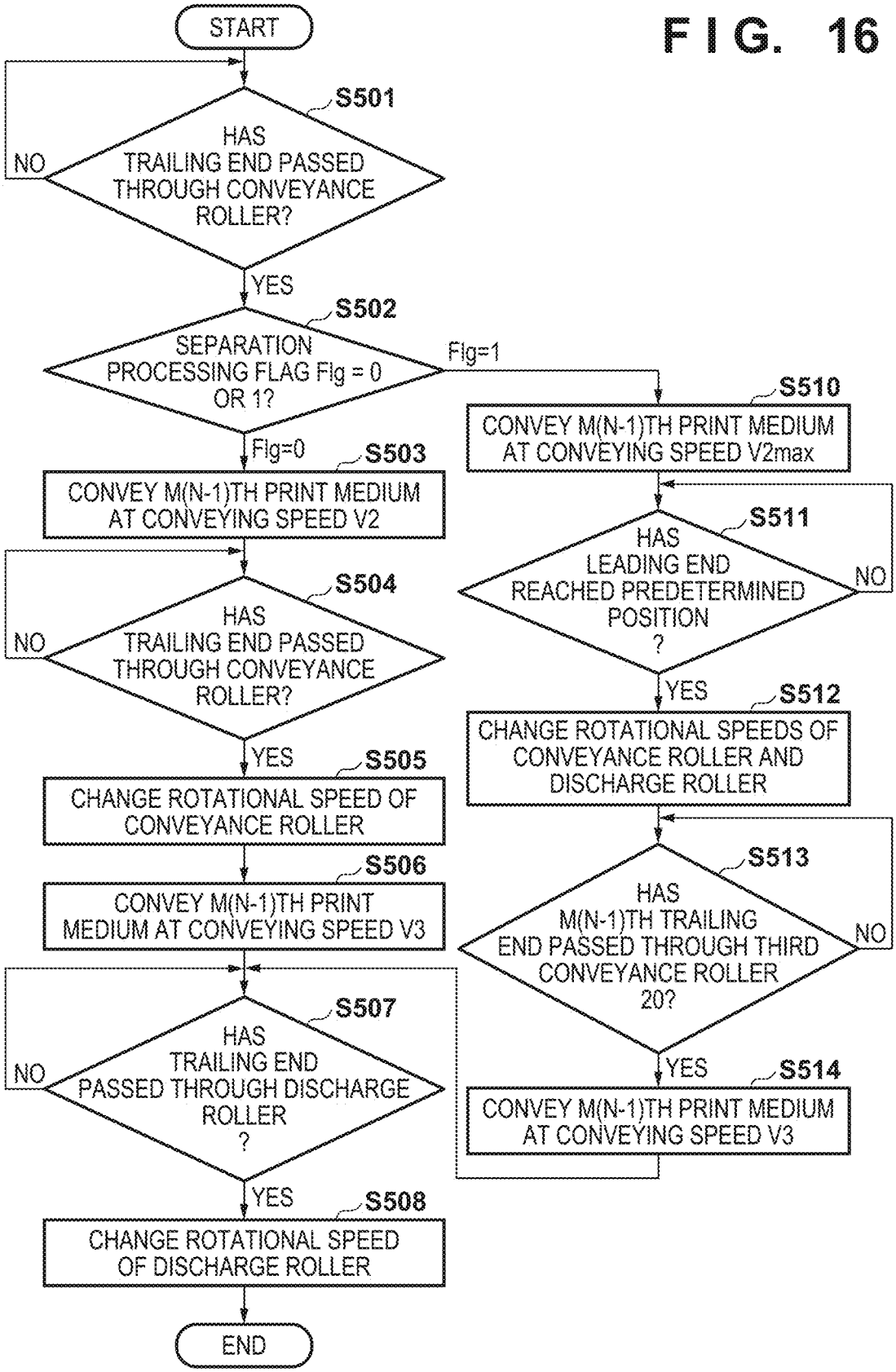
FIG. 16 is a flowchart showing an example of control of the printing apparatus in FIG. 1.

FIG. 16 is a control procedure for a separating operation in step S17 in FIG. 10B. In step S501, it is determined whether the trailing end of the M(N−1)th print medium P (the trailing end R1 of the preceding print medium P1) has passed through the conveyance roller 10. If it is determined that the trailing end has not passed through the conveyance roller 10 (step S501: NO), the processing in step S501 is repeated. In contrast to this, if it is determined that the trailing end has passed through the conveyance roller 10 (step S501: YES), the process advances to step S502. Note that the conveyance state when it is determined that the trailing end has passed through the conveyance roller 10 corresponds to the state in FIG. 14B.

In step S502, the separation processing flag Flg is read out from the RAM 203, and it is determined whether Flg is 0 or 1. If it is determined that Flg=0, the process advances to step S503. If it is determined that Flg=1, the process advances to step S510. In step S503, the conveying speed V2 is read out from the RAM 203, and the conveyance roller 20 and the discharge roller 22 are rotated to convey the M(N−1)th print medium P at the conveying speed V2.

In step S504, it is determined whether the trailing end of the M(N−1)th print medium P (the trailing end R1 of the preceding print medium P1) has passed through the conveyance roller 20. If it is determined that the trailing end has not passed through the conveyance roller 20 (step S504: NO), the processing in step S504 is repeated. In contrast, if it is determined that the trailing end has passed through the conveyance roller 20 (step S504: YES), the process advances to step S505. Note that the conveyance state when it is determined that the trailing end has passed through the conveyance roller 20 corresponds to the state in FIG. 14C.

In step S505, the rotational speed of the conveyance roller 20 is changed to the rotational speed corresponding to the conveying speed V1 to prepare for the conveyance of the M(N)th print medium P (succeeding print medium P2). The conveyance rollers 5, 10, and 20 are synchronously driven. In step S506, the conveying speed V3 is read out from the RAM 203, and the conveying speed of the M(N−1)th print medium P (preceding print medium P1) is switched to the conveying speed V3. The discharge roller 22 is rotated to convey the M(N−1)th print medium P at the conveying speed V3.

In step S507, it is determined whether the trailing end of the M(N−1)th print medium P (the trailing end R1 of the preceding print medium P1) has passed through the discharge roller 22. If it is determined that the trailing end has not passed through the discharge roller 22 (step S507: NO), the processing in step S507 is repeated. In contrast to this, if it is determined that the trailing end has passed through the discharge roller 22 (step S507: YES), the process advances to step S508. Note that the conveyance state when it is determined that the trailing end has passed through the discharge roller 22 corresponds to FIG. 14D.

In step S508, it is determined that the separating operation is completed, and the rotational speed of the discharge roller 22 is changed to the rotational speed corresponding to the conveying speed V1. The processing is then terminated.

In step S510, the rotational speed V2max is read out from the RAM 203, and the conveyance roller 20 and the discharge roller 22 are rotated to convey the M(N−1)th print medium P at the rotational speed V2max. In step S511, it is determined whether the leading end of the M(N)th print medium P (the leading end L2 of the succeeding print medium P2) has reached the front position at the distance Da from the conveyance roller 20. This conveyance state corresponds to the state in FIG. 15B. If it is determined that the leading end has not reached the position (step S511: NO), the processing in step S511 is repeated. In contrast, if it is determined that the position has reached the position (step S511: YES), the process advances to step S512.

In step S512, the rotational speed of the conveyance roller 20 and the discharge roller 22 is changed to the rotational speed corresponding to the conveying speed V1. The conveyance rollers 5, 10, 20, and 22 are synchronously driven. In step S513, it is determined whether the trailing end of the M(N−1)th print medium P (the trailing end R1 of the preceding print medium P1) has passed through the conveyance roller 20. If it is determined that the trailing end has not passed through the conveyance roller 20 (step S513: NO), the processing in step S513 is repeated. In contrast, if it is determined that the trailing end has passed through the conveyance roller 20 (step S153: YES), the process advances to step S514. Note that the conveyance state when it is determined that the trailing end has passed through the conveyance roller 20 corresponds to the state in FIG. 15C.

In step S514, the conveying speed V3 is read out from the RAM 203, and the conveying speed of the M(N−1)th print medium P (preceding print medium P1) is switched to the conveying speed V3. The discharge roller 22 is rotated to convey the M(N−1)th print medium P at the conveying speed V3. Thereafter, the process advances to step S507.

The processing is terminated in the above manner. In this embodiment, when a separating operation is to be performed, the preceding print medium P1 is continuously conveyed at a constant speed, for example, the conveying speed V2 or V2max. However, for example, the conveying speed may be controlled such that the average speed, including stoppage and acceleration, becomes V2 or V2max.

As has been described above, according to the above embodiment, it is possible to reduce the conveying speed of a preceding print medium and suppress increases in noise, power consumption, and the like when performing an operation of separating the preceding print medium from a succeeding print medium so as to cancel the overlap state.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-079581, filed May 12, 2023, which is hereby incorporated by reference herein in its entirety.

What is claimed is:

1. A printing apparatus comprising:

a printing unit configured to print an image on a print medium;

a first conveyance roller configured to convey the print medium in a conveying direction;

a second conveyance roller configured to convey the print medium having undergone printing by the printing unit on a downstream side of the first conveyance roller in the conveying direction; and a control unit configured to perform reduction control to reduce an overlap amount between a preceding print medium and a succeeding print medium by using a speed difference between the preceding print medium and the succeeding print medium in an overlap state in which the succeeding print medium overlaps a trailing end of the preceding print medium, wherein the control unit estimates a time from when the reduction control is started to when a leading end of the succeeding print medium reaches the second conveyance roller, in a first case in which a trailing end of the preceding print medium and the leading end of the succeeding print medium are positioned in an interval between the first conveyance roller and the second conveyance roller, the control unit is configured to execute the reduction control in which a conveying speed of the preceding print medium is set to a first speed based on the estimated time, and in a second case which is different from the first case and in which the trailing end of the preceding print medium and the leading end of the succeeding print medium are positioned in the interval between the first conveyance roller and the second conveyance roller, the control unit is configured to execute the reduction control in which the conveying speed of the preceding print medium is set to a second speed different from the first speed based on the estimated time.

2. The apparatus according to claim 1, wherein the control unit sets the conveying speed of the preceding print medium in the reduction control in accordance with print data associated with the succeeding print medium.

3. The apparatus according to claim 1, wherein the first speed is set to an upper limit speed, and the second speed is set to a speed lower than the upper limit speed.

4. The apparatus according to claim 1, wherein the control unit calculates a speed value that makes an interval between the preceding print medium and the succeeding print medium become a predetermined interval, sets the first speed to an upper limit speed as in the first case if the speed value exceeds the upper limit speed, and sets the second speed based on an estimated time as in the second case if the speed value is lower than the upper limit speed.

5. The apparatus according to claim 1, wherein the first case and the second case are cases in which print data of images printed on the succeeding print medium are different from each other.

6. The apparatus according to claim 2, wherein the control unit sets the conveying speed of the preceding print medium in the reduction control before printing on the preceding print medium by the printing unit is completed.

7. A printing apparatus comprising:

a printing unit configured to print an image on a print medium;

a first conveyance roller configured to convey the print medium in a conveying direction;

a second conveyance roller configured to convey the print medium having undergone printing by the printing unit on a downstream side of the first conveyance roller in the conveying direction;

a third conveyance roller configured to convey the print medium having undergone printing by the printing unit on a downstream side of the second conveyance roller in the conveying direction; and a control unit configured to perform reduction control to reduce an overlap amount between a preceding print medium and a succeeding print medium by using a speed difference between the preceding print medium and the succeeding print medium in an overlap state in which the succeeding print medium overlaps a trailing end of the preceding print medium, wherein in a first case in which a trailing end of the preceding print medium and a leading end of the succeeding print medium are positioned in an interval between the first conveyance roller and the second conveyance roller, the control unit is configured to execute the reduction control in which a conveying speed of the preceding print medium is set to a first speed, in a second case which is different from the first case and in which the trailing end of the preceding print medium and the leading end of the succeeding print medium are positioned in the interval between the first conveyance roller and the second conveyance roller, the control unit is configured to execute the reduction control in which the conveying speed of the preceding print medium is set to a second speed different from the first speed, in a third case in which the trailing end of the preceding print medium and the leading end of the succeeding print medium are positioned in an interval between the second conveyance roller and the third conveyance roller, the control unit is configured to execute the reduction control in which the conveying speed of the preceding print medium is set to a third speed, and in a fourth case which is different from the third case and in which the trailing end of the preceding print medium and the leading end of the succeeding print medium are positioned in the interval between the second conveyance roller and the third conveyance roller, the control unit is configured to execute the reduction control in which the conveying speed of the preceding print medium is set to a fourth speed different from the third speed.

8. The apparatus according to claim 7, wherein the third speed is set to an upper limit speed, and the fourth speed is set to a speed lower than the upper limit speed.

9. The apparatus according to claim 7, wherein the third case and the fourth case are cases in which print data of images printed on the succeeding print medium are different from each other.

10. The apparatus according to claim 7, wherein the control unit matches the conveying speed of the preceding print medium with the conveying speed of the succeeding print medium if the trailing end of the preceding print medium is positioned in the interval between the first conveyance roller and the second conveyance roller and the leading end of the succeeding print medium is positioned in the interval between the second conveyance roller and the third conveyance roller.

11. The apparatus according to claim 7, further comprising:

a fourth conveyance roller on an upstream side of the printing unit with respect to the conveying direction;

a fifth conveyance roller on an upstream side of the fourth conveyance roller with respect to the conveying direction, wherein the first conveyance roller, the second conveyance roller, and the third conveyance roller are arranged on a downstream side of the printing unit in the conveying direction, and the control unit forms the overlap state in which the succeeding print medium overlaps the trailing end of the preceding print medium by conveyance of the succeeding print medium by the fifth conveyance roller before the leading end of the succeeding print medium passes through the fourth conveyance roller.

12. The apparatus according to claim 7, wherein the control unit sets the conveying speed of the preceding print medium in the reduction control before completion of printing on the preceding print medium by the printing unit.

13. The apparatus according to claim 11, wherein the control unit does not form the overlap state if it is estimated that the trailing end of the preceding print medium does not precede the leading end of the succeeding print medium by a predetermined distance even if the preceding print medium is conveyed at the third speed in a case where the trailing end of the preceding print medium passes through the third conveyance roller.

* * * * *